US012635755B2

(12) United States Patent
Elnatan et al.

(10) Patent No.: US 12,635,755 B2
(45) Date of Patent: May 26, 2026

(54) MULTI-LEVEL FOOTWEAR SOLE

(71) Applicants: Shimon Shay Elnatan, Petach-Tikva (IL); Amihay Avital, Petach-Tikva (IL)

(72) Inventors: Shimon Shay Elnatan, Petach-Tikva (IL); Amihay Avital, Petach-Tikva (IL)

( * ) Notice: Subject to any disclaimer, the term of this patent is extended or adjusted under 35 U.S.C. 154(b) by 0 days.

(21) Appl. No.: 18/267,567

(22) PCT Filed: Dec. 16, 2021

(86) PCT No.: PCT/IL2021/051501
§ 371 (c)(1),
(2) Date: Jun. 15, 2023

(87) PCT Pub. No.: WO2022/130387
PCT Pub. Date: Jun. 23, 2022

(65) Prior Publication Data

US 2024/0041153 A1 Feb. 8, 2024

Related U.S. Application Data

(60) Provisional application No. 63/126,865, filed on Dec. 17, 2020.

(51) Int. Cl.
*A43B 3/00* (2022.01)
*A43B 5/14* (2006.01)
*A43B 7/38* (2006.01)

(52) U.S. Cl.
CPC ..... *A43B 3/0036* (2013.01); *A43B 5/145* (2013.01); *A43B 7/38* (2013.01)

(58) Field of Classification Search
CPC ..... A43B 7/38; A43B 3/0036; A43B 5/145; A63C 17/12
USPC ..... 36/103
See application file for complete search history.

(56) References Cited

U.S. PATENT DOCUMENTS 675,824 A * 6/1901 Fohr ..... A63C 17/10 280/844
4,572,528 A * 2/1986 McBride ..... A63C 17/10 280/844
D319,678 S * 9/1991 Loverme ..... D21/766
5,390,958 A * 2/1995 Soo ..... A63C 17/10 280/844
5,580,096 A * 12/1996 Freilich ..... A63C 17/10 280/844
5,730,241 A * 3/1998 Shyr ..... A63C 17/10 180/181
2012/0325567 A1* 12/2012 Ganeous ..... A63C 17/10 180/9.23

(Continued)

*Primary Examiner* — Timothy K Trieu
(74) *Attorney, Agent, or Firm* — Vladimir Sheman

(57) ABSTRACT

Disclosed is a multi-level footwear sole including a lower section having a top side and a bottom side for contacting the ground; an upper section having a top side and a bottom side for interfacing with one or more components of a two-wheel vehicle; and one or more interconnection elements/sections for orienting and retaining the upper level in relation to the lower level, such that the upper and lower levels are positioned at substantially parallel planes, at least partially overlap, wherein the bottom side of the upper section faces the top side of the bottom section, forming therebetween one or more hollow chambers to accommodate/house the interfaced components of the two-wheel vehicle.

8 Claims, 23 Drawing Sheets

Multi-level sole's lower section generates extra leg reach enabling the rider to simultaneously contact the ground on both sides of the motor bike while seating in the rider's seat

(56) References Cited

U.S. PATENT DOCUMENTS

| | | | | |
|---|---|---|---|---|
| 2013/0221738 | A1* | 8/2013 | Boivin | B62D 55/12 305/20 |
| 2020/0038737 | A1* | 2/2020 | Potter | A63C 5/035 |
| 2021/0331768 | A1* | 10/2021 | Rudofsky | B62M 27/02 |
| 2023/0097559 | A1* | 3/2023 | Lewison | A63C 13/006 36/122 |

* cited by examiner

Multi-level sole's lower section generates extra leg reach enabling the rider to simultaneously contact the ground on both sides of the motor bike while seating in the rider's seat Multi-level sole's upper section interfaces with motorbike components (leg rest and footbrake paddle) facilitating their control and operation by the rider Integrated footwear sole (on which the wearer rests his foot) and Multi-level footwear sole's upper section

MULTI-LEVEL FOOTWEAR SOLE

FIELD OF THE INVENTION

The present invention generally relates to the field of bike and motorbike gear and accessories. More specifically, the present invention relates to a multi-level footwear sole for extending the leg reach of a two-wheel vehicle's rider and facilitating interface with the vehicle's operation and control components.

BACKGROUND

Motorbike riders of lower height (<175 cm) often have real problems riding and operating "tall" motorcycles. Such problems include, to name a few: stance, stopping and standstill stabilizing standing on even or non-even ground, slide, mount, dismount, passenger mount, reverse back up, and performance related issues. These and other challenges are an issue on flat even ground, while on non-even or non-flat ground they get even harder to overcome for riders of any height.

The above limitation creates exponential level of fear and discouragement among lower height bike riders that are limited, for many years now, to only low height seat bike models. Motorbike operation and riding problems can invoke safety issues such as: forced minimum riding speeds, side fallings of the bike and rider, loss of balance or stability issues and others.

As motorcycles suspension imposes ever increasing rider's seat height, to improve rough road handling and ground clearance—in particular, among typically tall motor bike types, such as: Adventure-Touring, Dual Sports, Enduro & Motocross—many riders spend considerate amounts of time, effort and money to try and modify tall bikes to fit their stem limitation.

Some existing solutions, attempting to solve the lower height rider problems, include: Insoles-interal to the rider's boot—uncomfortable and cripples the controls action, not commonly used; a "Link", lowering the shock absorber—has limited effect (2-3 cm), reduces motor performance and is unrecommended by mechanics, one of the most common actions taken; Seat "Shaving"—has limited effect (2 cm) and reduces seat cushioning, commonly practiced; and Shock treatment—Shorter springs or a Shock Space limiter—an expensive solution (>$1000), damages the riding experience and capability in rough terrain off-road, deforms motorcycle geometry and iconic looks, damages motorcycle shock absorbing capability and reduces ground clearance.

There remains a need, in the field of bike and motorbike gear and accessories, for solutions for extending the leg reach of a two-wheel vehicle's rider while facilitating interface with the vehicle's operation and control components.

SUMMARY OF THE INVENTION

Embodiments of the present invention include a multi-level footwear sole for extending the leg reach of a two-wheel vehicle's rider and facilitating operation control and interface of the two-wheel vehicle's components.

There may be provided, in accordance with some embodiments, a multi-level footwear sole including: (1) a lower section (level) having a top side and a bottom (outsole) side for contacting the ground; (2) an upper section (level) having a top side and a bottom (outsole) side for interfacing with one or more components (physical/control/operational) of a two-wheel vehicle; and (3) one or more interconnection elements/sections for orienting and retaining the upper level in relation to the lower level, such that the upper and lower levels are: (a) are positioned at substantially parallel planes and (b) at least partially overlap, wherein the bottom side of the upper section faces the top side of the bottom section, forming therebetween one or more hollow chambers to accommodate/house the interfaced components of the two-wheel vehicle.

The interconnection elements/sections, in accordance with some embodiments, may position the upper and lower sections at a specific distance, or within a specific range of distances, of one another, to enable seamless attachment/detachment of the (rider foot worn) multi-level sole onto the motorcycle's peg, while preventing the hitting of motorbike controls or peg when lifting the foot off, or resting the foot on, the peg.

According to some embodiments, a multi-level footwear sole may include interconnection elements that form, in concert with the lower and upper sections, a closed belt loop shape, wherein the lower and upper sections are connected at their fronts (toes) and at their rears (heels) and the multi-level sole is open/hollow from/on both its instep-arch and outer-foot sides.

According to some embodiments, a multi-level sole as described herein may include, and may be connected with a footwear using, any combination of the following connection elements: straps, rubber/flexible bands, laces, buckles, ratchets, Velcro straps/buckles and/or others.

According to some embodiments, a multi-level footwear sole may be integrated with a footwear such as, for example, a regular shoe and/or a bike/motorbike riding shoe or boot. A footwear having an integrated multi-level footwear sole, in accordance with embodiments, may include an integration between the sole of the footwear (on which the wearer rests his foot) and the upper section of the multi-level footwear sole as described herein.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings:

Figure 1A:
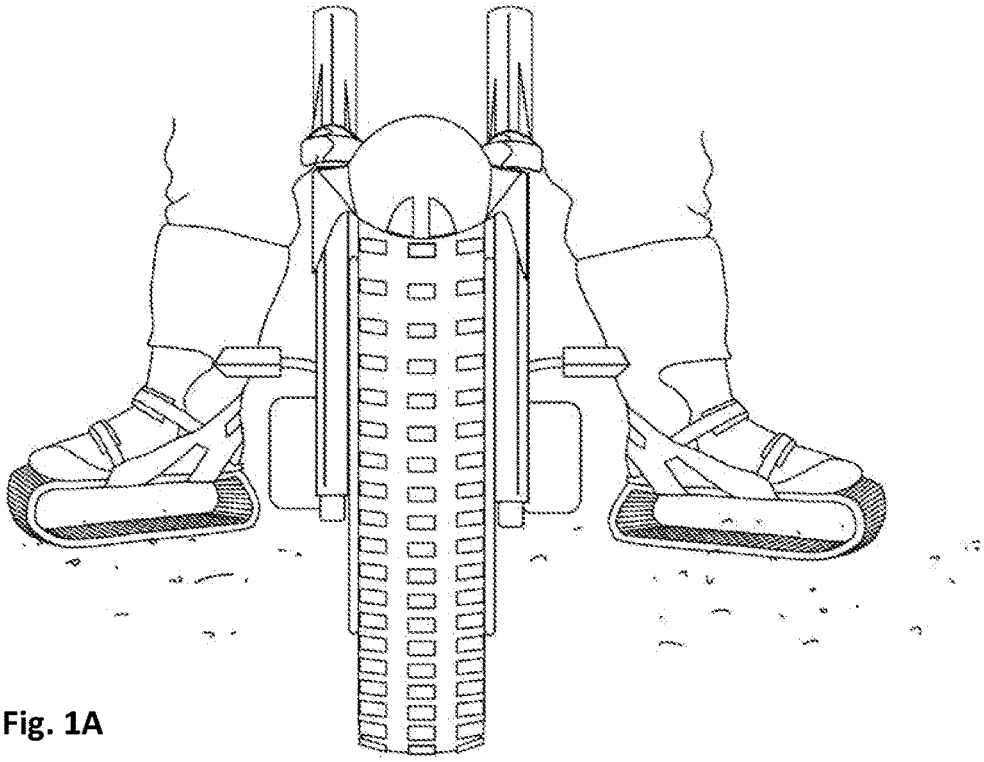
In FIG. 1A there is shown an exemplary multi-level footwear sole, in accordance with embodiments, worn over a motorbike rider's boot, in a motorbike standing position.

It will be appreciated that for simplicity and clarity of illustration, elements shown in the FIGURES have not necessarily been drawn to scale. For example, the dimensions of some of the elements may be exaggerated relative to other elements for clarity. Further, where considered appropriate, reference numerals or element labeling may be repeated among the FIGURES to indicate corresponding or analogous elements.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Functions, operations, components and/or features described herein with reference to one or more embodiments, may be combined with, or may be utilized in combination with, one or more other functions, operations, components and/or features described herein with reference to one or more other embodiments.

The terminology used herein is for the purpose of describing particular embodiments only and is not intended to be limiting of the invention. As used herein, the term "and/or" includes any, and all, combinations of one or more of the associated listed items. As used herein, the singular forms "a," "an," and "the" are intended to include the plural forms as well as the singular forms, unless the context clearly indicates otherwise. It will be further understood that the terms "includes", "including", "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention and is not intended to limit the invention to the specific embodiments illustrated by the FIGURES or description below.

The terms: two-wheel vehicle, bike, motorbike, motorcycle, bicycle, or the like, as used herein, may refer to all and any type of a two-wheeled vehicle and may be used interchangeably. The described invention may be practiced in relation to, applied to, and benefit the riders/drivers/operators of, various other vehicles and machinery types.

Embodiments of the present invention include a multi-level footwear sole for extending the leg reach of a two-wheel vehicle's rider and facilitating operation control and interface of the two-wheel vehicle's components.

There may be provided, in accordance with some embodiments, a multi-level footwear sole including: (1) a lower section (level) having a top side and a bottom (outsole) side for contacting the ground; (2) an upper section (level) having a top side and a bottom (outsole) side for interfacing with one or more components (physical/control/operational) of a two-wheel vehicle; and (3) one or more interconnection elements/sections for orienting and retaining the upper level in relation to the lower level, such that the upper and lower levels are: (a) are positioned at substantially parallel planes and (b) at least partially overlap, wherein the bottom side of the upper section faces the top side of the bottom section, forming therebetween one or more hollow chambers to accommodate/house the interfaced components of the two-wheel vehicle.

The interconnection elements/sections, in accordance with some embodiments, may position the upper and lower sections at a specific distance, or within a specific range of distances, of one another, to enable seamless attachment/ detachment of the (rider foot worn) multi-level sole onto, and off, the motorcycle's peg, while preventing the hitting of motorbike controls or peg when lifting the foot off, or resting the foot on, the peg. For example, the upper and lower sections may be positioned, by the interconnection elements/sections, at a distance(s) of between 5 cm and 20 cm from one another.

According to some embodiments, the upper and lower sections and/or the interconnection elements/sections of the multi-level footwear sole may be produced as a single unit or may constructed from multiple subcomponents or parts. The entire multi-level footwear sole, or its subcomponents/parts, may be produced/fabricated using any combination of industrial processes, such as: molding, casting, forging, extrusion, thermoforming, computer numerical control (CNC), 3-dimensional printing and/or other.

Figure 1B:
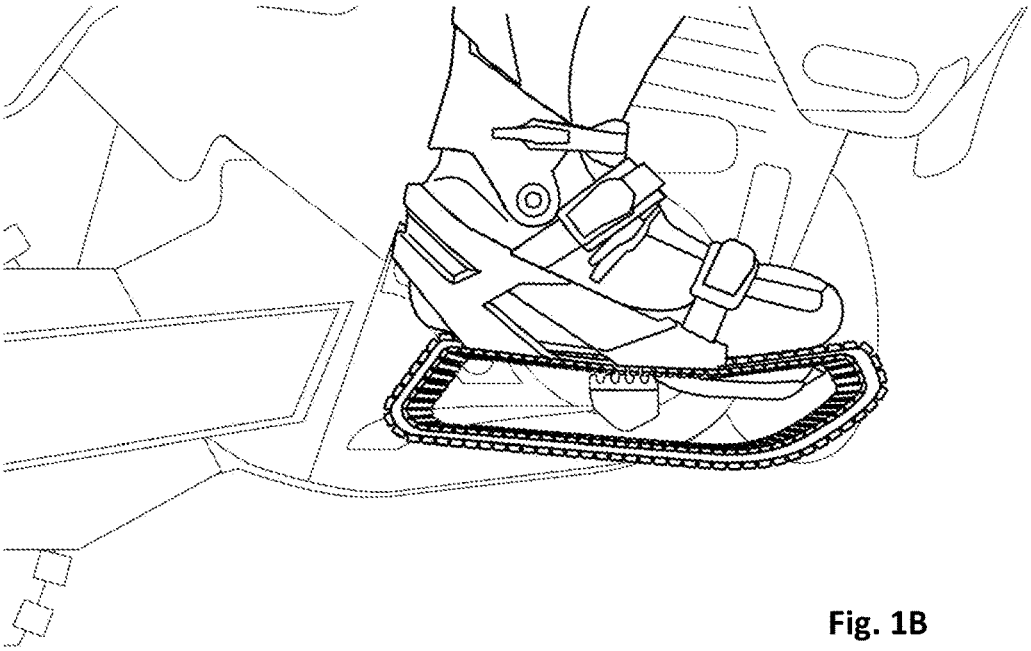
In FIG. 1B there is shown an exemplary multi-level footwear sole, in accordance with embodiments, worn over a motorbike rider's boot, in a motorbike riding position.

Reference is now made to FIGS. 1A and 1B where there is shown an exemplary multi-level footwear sole, in accordance with embodiments, worn over a motorbike rider's boot, in: a motorbike standing position—where the multi-level sole's lower section generates extra leg reach enabling the rider to simultaneously contact the ground on both sides of the motor bike while seating in the rider's seat (FIG. 1A); and a motorbike riding position—where the multi-level sole's upper section interfaces with motorbike components (leg rest and footbrake paddle) facilitating their control and operation by the rider (FIG. 1B).

According to some embodiments, a multi-level footwear sole may include interconnection elements that form, in concert with the lower and upper sections, a closed belt loop shape, wherein the lower and upper sections are connected at their fronts (toes) and at their rears (heels) and the multi-level sole is open/hollow from/on both its instep-arch and outer-foot sides.

According to some embodiments, a multi-level sole as described herein may include, and may be connectable with a footwear, using any combination of the following connection elements: straps, screws and bolts, rubber/flexible bands, laces, buckles, ratchets, Velcro straps/buckles and/or others.

Figure 2A:
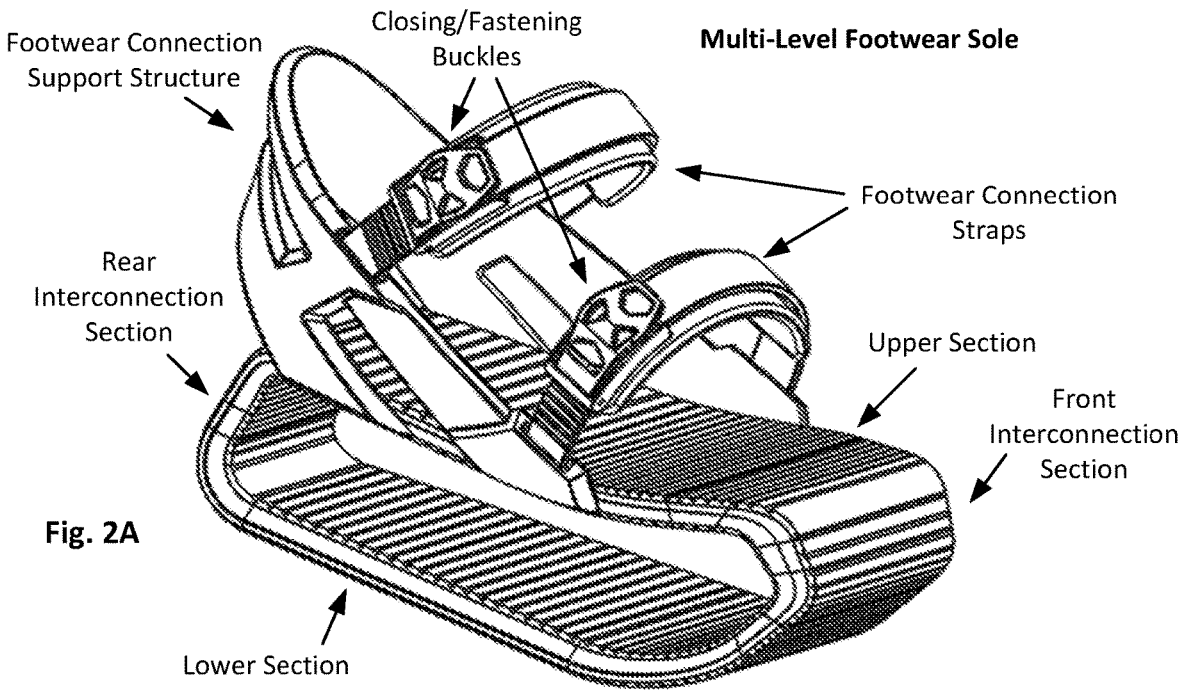
In FIG. 2A there is shown a front isometric view of an exemplary multi-level footwear sole of a closed belt loop shape, in accordance with embodiments.

Reference is now made to FIG. 2A where there is shown a front isometric view of an exemplary multi-level footwear sole of a closed belt loop shape, in accordance with embodiments. In the FIGURE, there are shown: the upper section, lower section, rear and front interconnection sections, footwear connection straps including closing/fastening buckles and a footwear connection support structure, of the multi-level sole.

Figure 2B:
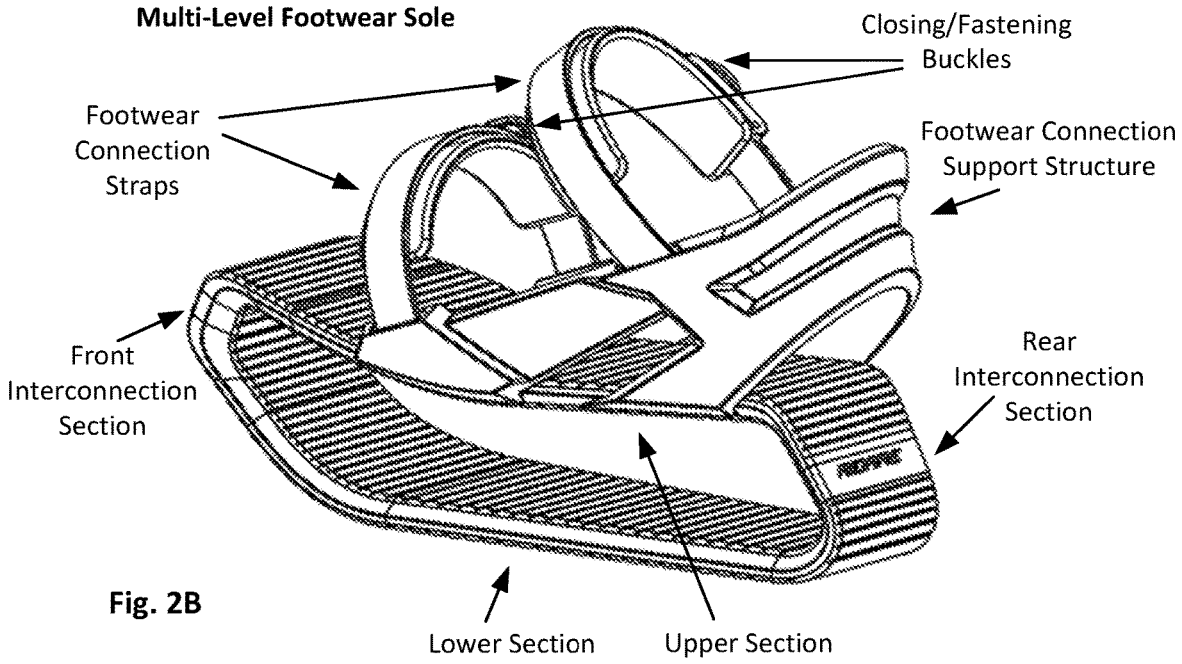
In FIG. 2B there is shown a back isometric view of an exemplary multi-level footwear sole of a closed belt loop shape, in accordance with embodiments.

Reference is now made to FIG. 2B where there is shown a back isometric view of an exemplary multi-level footwear sole of a closed belt loop shape, in accordance with embodiments. In the FIGURE, there are shown: the upper section, lower section, rear and front interconnection sections, the footwear connection straps including the closing/fastening buckles and the footwear connection support structure, of the multi-level sole.

According to some embodiments, the structure of the upper section of the multi-level sole may be bent/bowled/lowered at its center/front-center section, inclining towards the front (toes) side and back (heel) side of the upper section.

According to some embodiments, the bottom section of the multi-level sole may incline upwards and forward at its front (toes) side, to meet a front interconnect section connecting the lower and upper sections at their front (toes) sides. The created sloped section may act as a sled's runner/track, preventing the sole from getting caught/stuck on ground obstacles—such as stones, bumps, cracks and the like—when a two-wheel vehicle rider contacts the ground with his foot/feet as part of: turning, balancing, advancing slowly and/or slowing to stop.

According to some embodiments, the connection areas between the upper and lower sections and the interconnection sections may have a round structure, avoiding sharp corners and edges that may get caught/stuck on obstacles.

According to some embodiments, the front interconnect section may be thicker in proportion to the other interconnect sections and/or lower and upper sections—to provide bumping/cushioning collusion protection of the rider's toes and foot.

According to some embodiments, the bottom section and/or the upper section of the multi-level sole may widen towards their front (toes) side. The sole's widening may prevent rider's foot/leg contact with moving, hot, or otherwise unsafe motorcycle components; and may prevent penetration/entanglement of small rider-wear elements such as biking boot laces or braces, into/with bike/motorbike/motorcycle operating components, constituting a risk to both the vehicle and its rider.

According to some embodiments, the landscape of the outsole side of the upper section of the multi-level sole may be specifically shaped or include indents, grooves, holes, flaps, pins and/or other elements, on the bottom (outsole) side of the upper section (level) to accommodate/compliment one or more two-wheel vehicle components.

According to some embodiments, the upper and lower sections and/or the interconnection elements/sections may be constructed of, or include outer layers/surfaces made of, elastic materials and may provide further cushioning to the rider's feet, legs and body, when wearing the multi-level sole.

According to some embodiments, the bottom surfaces (outsoles), and/or additional surface(s), of the upper section, lower section and interconnection sections may include a non-slip/anti-skid/grip/rubber layer to prevent loss of contact with, or control of, a two-wheel vehicle component.

According to some embodiments, the bottom surfaces (outsoles), and/or additional surface(s), of the upper section, lower section and interconnection sections may include cross channels, for example on the non-slip/anti-skid/grip/rubber layer, to compliment ridges or edges on a two-wheel vehicle component (e.g. foot peg).

According to some embodiments, the upper surface of the lower section and/or the inwards facing surfaces of the interconnection sections may include a slippery/smooth/flat layer to facilitate seamless release of the multi-level footwear sole from a riding position, where bike components are interfaced by the sole, to a standing position, where rider and bike are supported by the sole(s) is/are in contact with the ground.

Figure 2C:
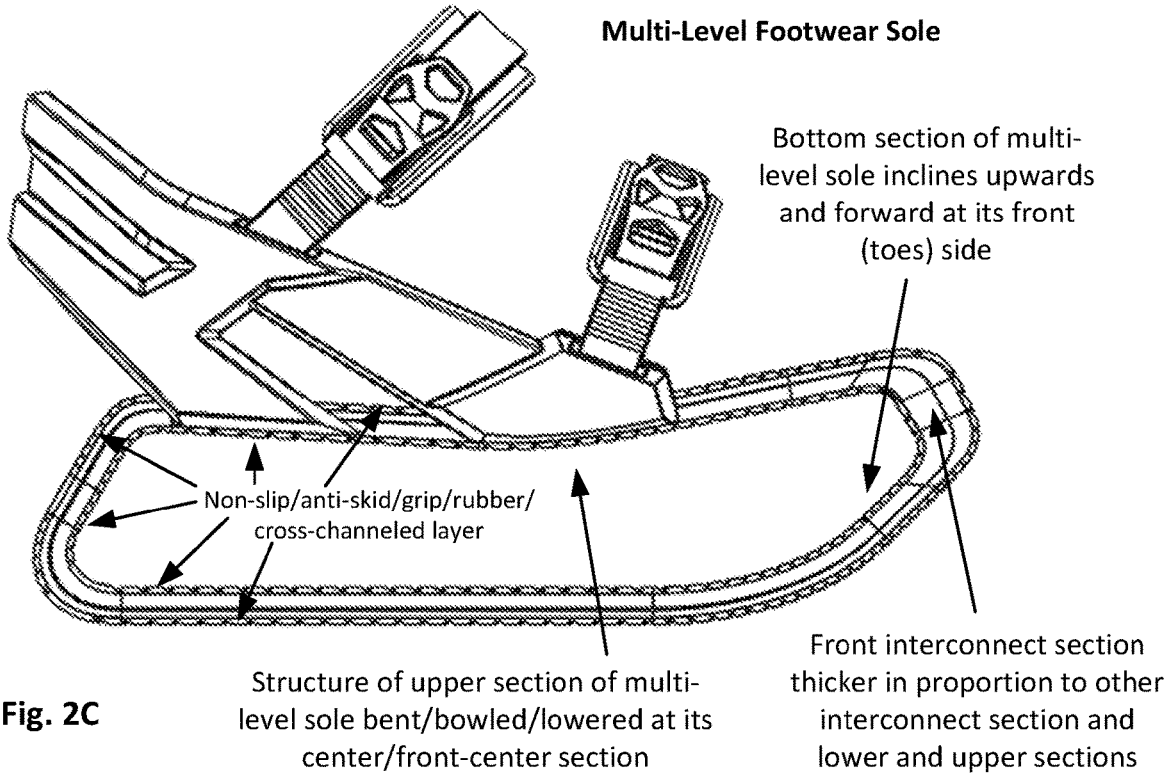
In FIGS. 2C and 2D there are shown a side view (2C) and a top view (2D) of an exemplary multi-level footwear sole of a closed belt loop shape, in accordance with embodiments.
Figure 2D:
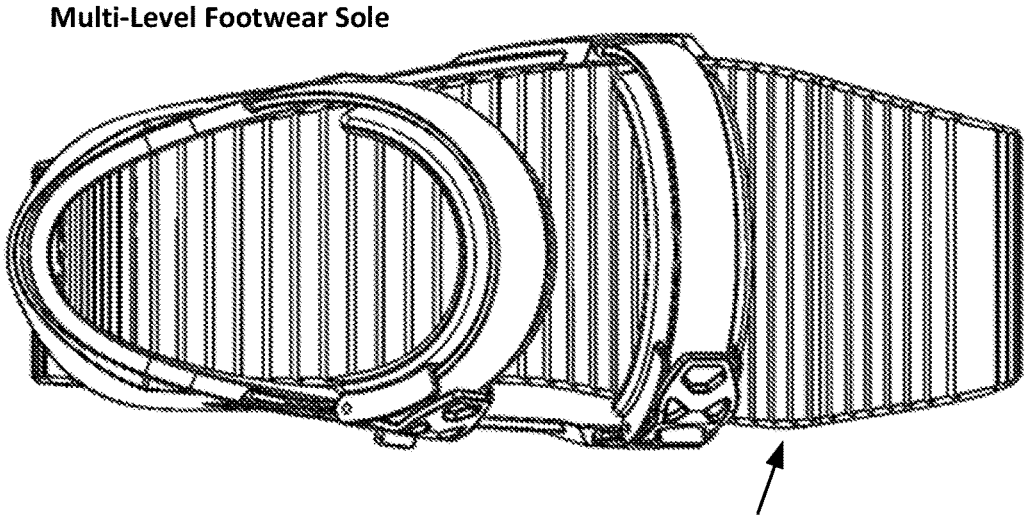

Reference is now made to FIGS. 2C and 2D where there are shown a side view (2C) and a top view (2D) of an exemplary multi-level footwear sole of a closed belt loop shape, in accordance with embodiments.

In FIG. 2C, the multi-level footwear sole is shown to have an upper section, that is bent/bowled/lowered at its center/front-center section. The bottom section of the multi-level sole inclines upwards and forward at its front (toes) side. The front interconnect section is thicker in proportion to the other interconnect section and the lower and upper sections. The bottom surfaces (outsoles), and additional surface(s), of the upper section, lower section and interconnection sections are shown to be covered by a non-slip/anti-skid/grip/rubber/cross-channeled layer.

In FIG. 2D, the multi-level footwear sole is shown to have an upper section, and a bottom section, that widen from the heel area and towards their front, approximately up to the area of the big and little toes' bases, and then slightly narrow from the toes' bases area and towards the toes area.

According to some embodiments, a multi-level footwear sole may be integrated with a footwear such as, for example, a regular shoe and/or a bike/motorbike riding shoe or boot. A footwear having an integrated multi-level footwear sole, in accordance with embodiments, may include an integration between the sole of the footwear (on which the wearer rests his foot) and the upper section of the multi-level footwear sole as described herein.

Figure 3A:
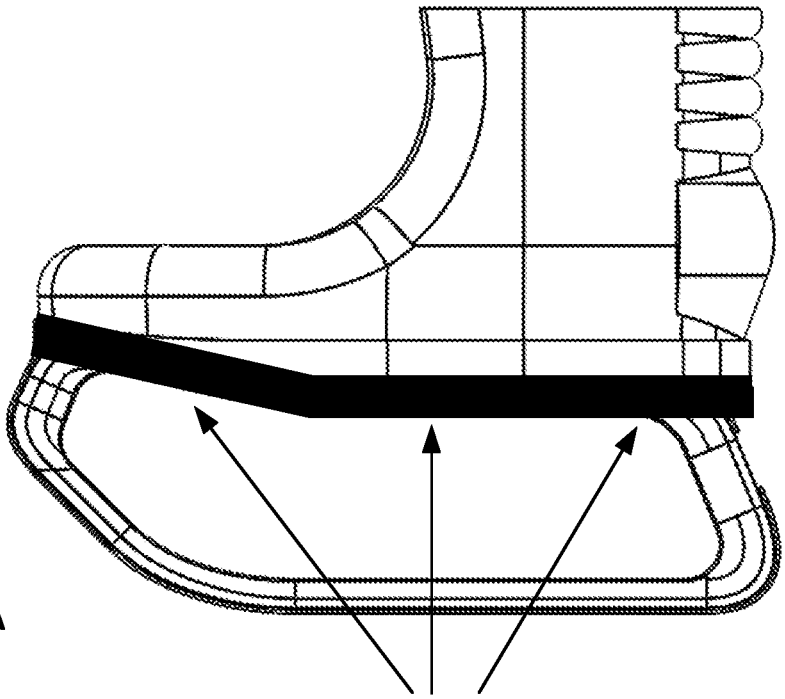
In FIG. 3A there is shown a schematic view of an exemplary multi-level footwear sole integrated with a motorbike boot, in accordance with embodiments.

Reference is now made to FIG. 3A where there is shown a schematic view of an exemplary multi-level footwear sole integrated with a motorbike boot, in accordance with embodiments. In the FIGURE, the exemplary boot-integrated multi-level footwear sole is shown to include a single integrated footwear sole, functioning as both the wearers footrest area (top surface of integrated sole) and the upper section of the multi-level footwear sole (bottom surface of integrated sole) to facilitate operation control and interface of the two-wheel vehicle's components.

According to some embodiments, a multi-level footwear sole may take the form of, or be integrated with, a galosh/overshoe, adapted for being worn over a regular, or bike/motorbike riding, shoe or boot.

According to some embodiments, the inner, rider's shoe/boot facing, side of a multi-level footwear sole's connection straps and/or connection support structure may include and be at least partially covered with a flexible layer such as rubber, wool, or Styrofoam, to generate pressure against, and thereby retain, the wearing rider's shoe or boot within the multi-level footwear sole.

Figure 3B:
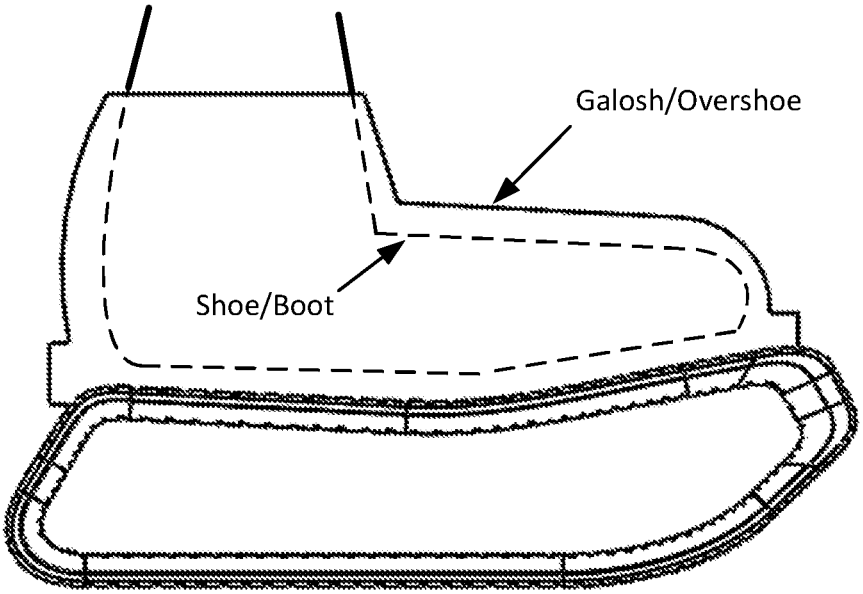
In FIG. 3B there is shown a schematic view of an exemplary multi-level footwear sole integrated with a galosh/overshoe, in accordance with embodiments.

Reference is now made to FIG. 3B where there is shown a schematic view of an exemplary multi-level footwear sole integrated with a galosh/overshoe, in accordance with embodiments. In the FIGURE, the exemplary galosh-integrated multi-level footwear is shown to be worn over the wearer's shoe/boot indicated with a broken line, inside the galosh.

Figure 4A:
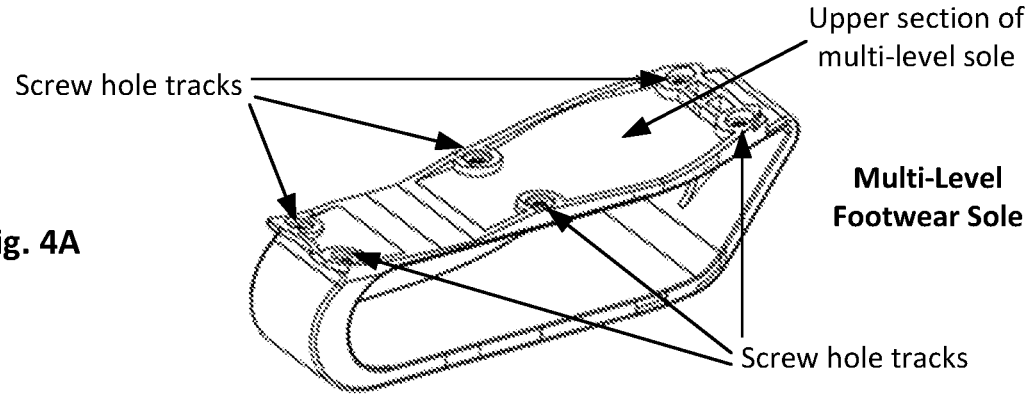
In FIG. 4A there is shown a first perspective view of an exemplary multi-level footwear sole including a screws-based footwear connection mechanism, in accordance with embodiments.

According to some embodiments, a multi-level footwear sole may be connected to a footwear, or to a footwear connection structure, by any combination of: (1) a straps and buckles mechanism as described and shown hereinbefore; (2) a click-to-lock mechanism, on the top of the upper section of the multi-level sole, adapted to click/hook onto a structure/pin/shaft on the outsole of the footwear; (3) a screws based connection mechanism; and/or (4) any footwear connection mechanism known today or to be devised, including any mechanism or solution utilized for skiing, snowboarding, waterskiing, surfing, windsurfing, biking and/or motorbiking purposes Reference is now made to FIG. 4A where there is shown a first perspective view of an exemplary multi-level footwear sole including a screws-based footwear connection mechanism, in accordance with embodiments. In the FIGURE there are shown six screw hole tracks, each having a corresponding screw adapted to be screwed up and across the upper section of the multi-level sole, into complementary screw holes on the bottom/outsole of the footwear being connected to.

Figure 4B:
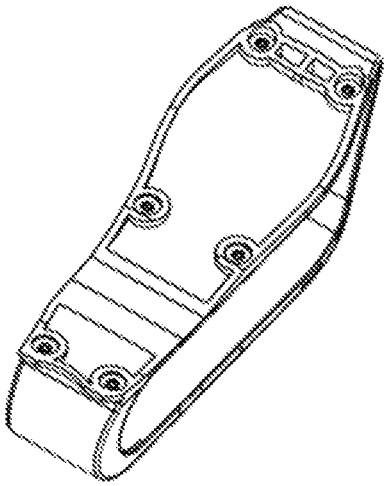
In FIGS. 4B-4D there are shown a second perspective view (4B), a top view (4C) and a side cross-section view (4D), of an exemplary multi-level footwear sole including a screws-based footwear connection mechanism, in accordance with embodiments.
Figure 4C:
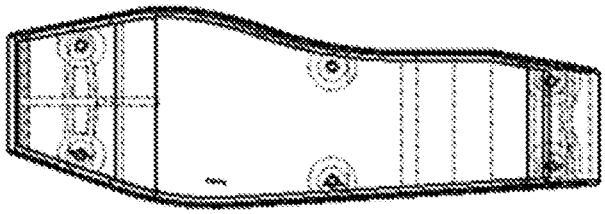
Figure 4D:
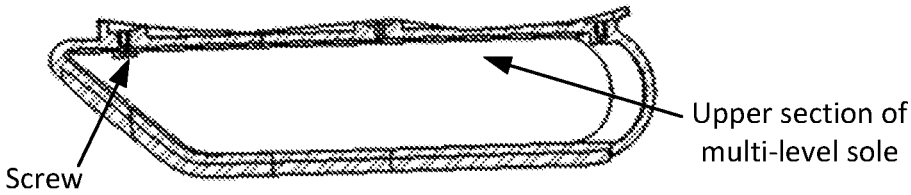

Reference is now made to FIGS. 4B-4D where there are shown a second perspective view (4B), a top view (4C) and a side cross-section view (4D), of an exemplary multi-level footwear sole including a screws-based footwear connection mechanism, in accordance with embodiments.

Figure 5A:
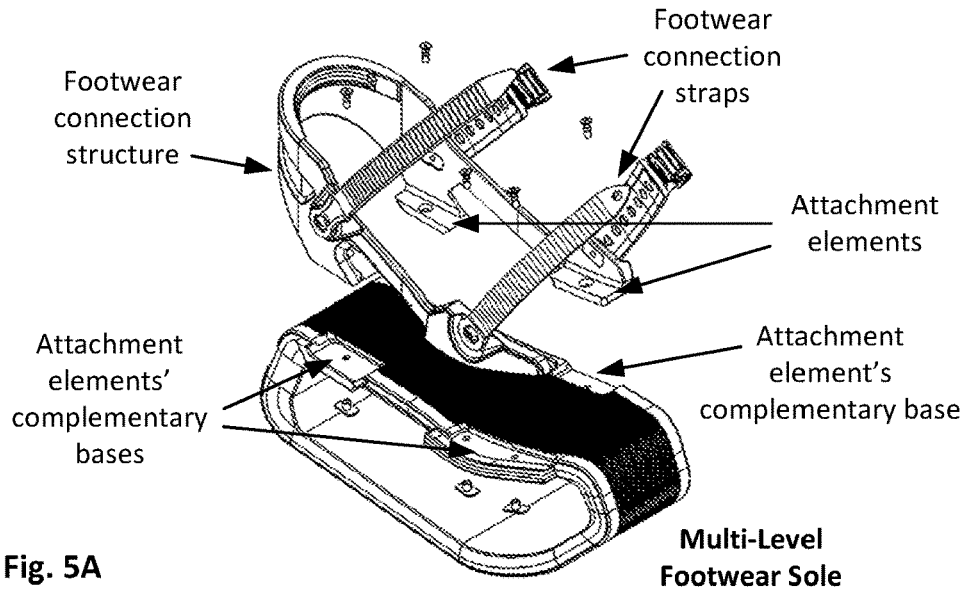
In FIG. 5A there is shown a first perspective view of an exemplary multi-level footwear sole including a bolts/screws-based footwear-connection-structure attachment mechanism, in accordance with embodiments.

Reference is now made to FIG. 5A where there is shown a first perspective view of an exemplary multi-level footwear sole including a bolts/screws-based footwear-connection-structure attachment mechanism, in accordance with embodiments. In the FIGURE the footwear-connection-structure is shown to include footwear connection straps. Further shown are screw hole tracks, and corresponding screws adapted to be screwed down and across attachment elements of the footwear-connection-structure, through attachment elements' complementary bases on the upper section of the multi-level sole, and into respective nuts on the bottom/outsole side of the upper section of the multi-level footwear.

Figure 5B:
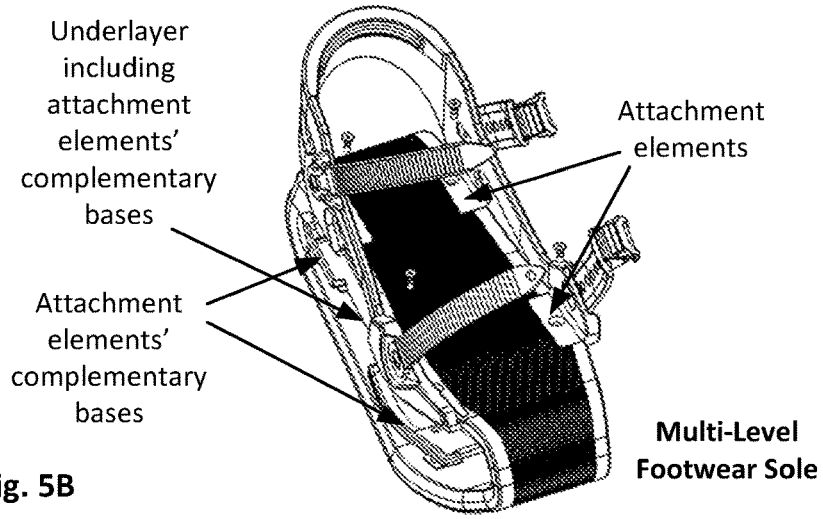
In FIGS. 5B-5C there are shown, a second top perspective view (5B), and a side view (5C), showing a separate connectable underlayer of the footwear-connection-structure attachment mechanism, in accordance with embodiments.
Figure 5C:
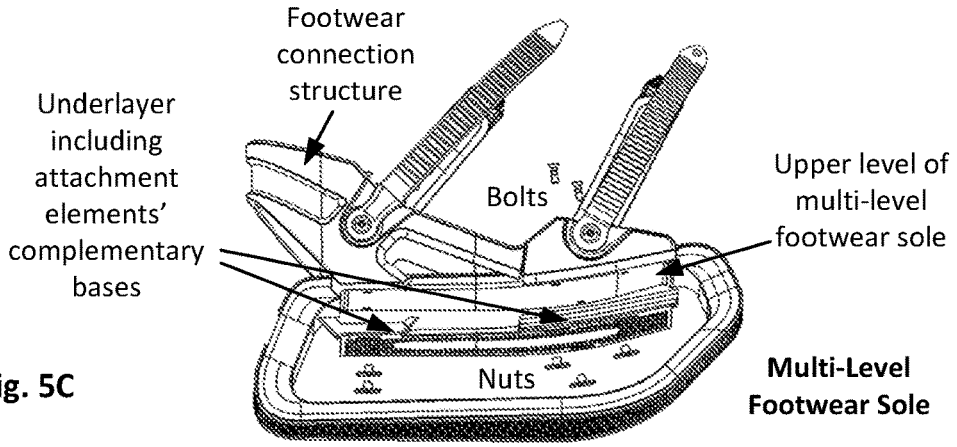

Reference is now made to FIGS. 5B-5C where there are shown a second top perspective view (5B), and a side view (5C), showing a separate connectable underlayer including/interconnecting the attachment elements' complementary bases, and adapted to connect therewith to the multi-level footwear sole and to the footwear connection structure, of an exemplary multi-level footwear sole including a screws-based footwear-connection-structure attachment mechanism, in accordance with embodiments.

Figure 5D:
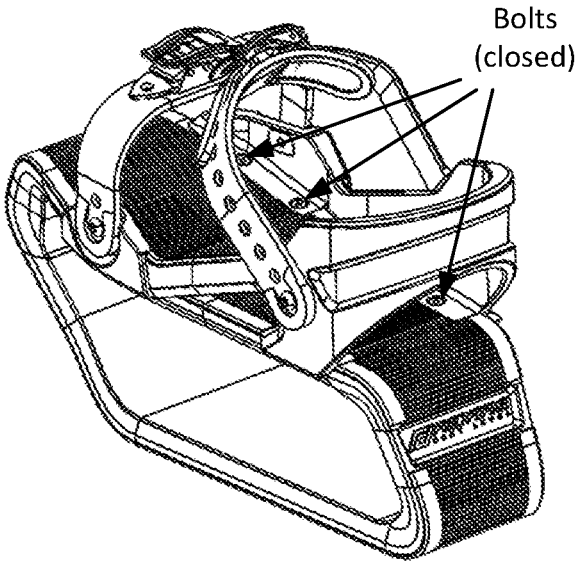
In FIG. 5D there is shown a top perspective view of an exemplary multi-level footwear sole including a screws-based footwear-connection-structure attachment mechanism, in accordance with embodiments.

Reference is now made to FIG. 5D where there is shown a top perspective view of an exemplary multi-level footwear sole including a screws-based footwear-connection-structure attachment mechanism, in accordance with embodiments. In the FIGURE the footwear-connection-structure is shown to be connected to the multi-level footwear sole by the shown bolts, another two bolts (not shown) connect the footwear-connection-structure to the multi-level footwear sole on its internal, foot arch, side.

Figure 5E:
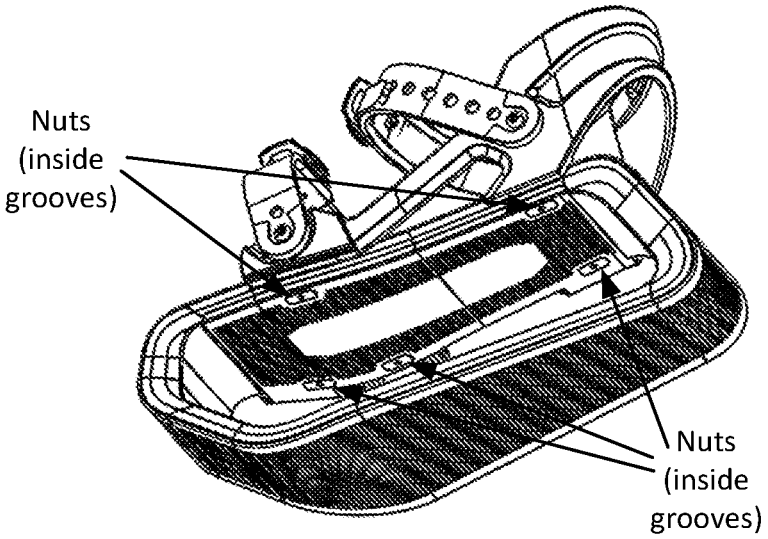
In FIG. 5E there is shown a bottom perspective view of an exemplary multi-level footwear sole including a screws-based footwear-connection-structure attachment mechanism, in accordance with embodiments.

Reference is now made to FIG. 5E where there is shown a bottom perspective view of an exemplary multi-level footwear sole including a screws-based footwear-connection-structure attachment mechanism, in accordance with embodiments. In the FIGURE, the footwear-connection-structure is shown to be connected to the multi-level footwear sole by the shown nuts—that are positioned at the bottom of the upper section of the multi-level sole and connect to the bolts, described in connection with FIG. 5D, penetrating from the top side of, and through, the upper section. When closed/tightened, the bolts are shown to pull and position their corresponding nuts into/inside grooves/nut-opening on the bottom side of the upper section of the multi-level sole; such that, the bottom surface of the upper section, the bottom surface of the optional attachment bases underlayer (when utilized), and the nuts submerged into their grooves—collectively form a substantially flat surface of similar height.

Figure 5F:
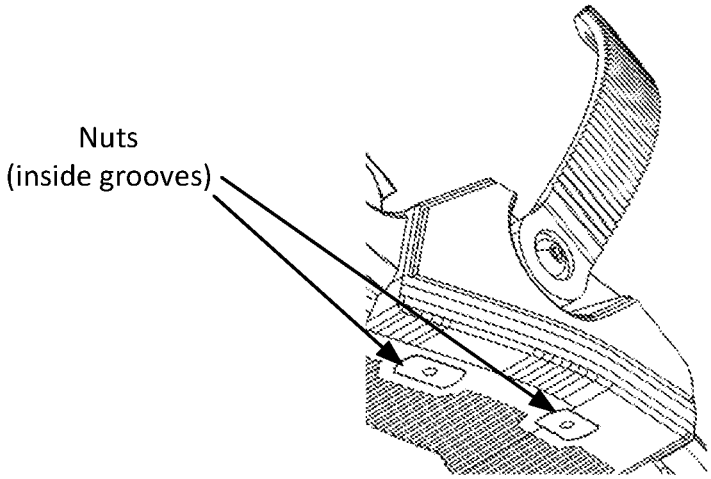
In FIG. 5F there is shown a first bottom perspective zoom-in view of the bottom surface of the upper section of the multi-level footwear sole, in accordance with embodiments.

Reference is now made to FIG. 5F where there is shown a bottom perspective zoom-in view showing two nuts connecting, along with respective bolts, the front outer side of an exemplary multi-level footwear sole with a footwear-connection-structure. The groove-sunk bolts are shown to form a flat surface with the bottom surface of the upper section of the multi-level footwear sole.

Figure 5G:
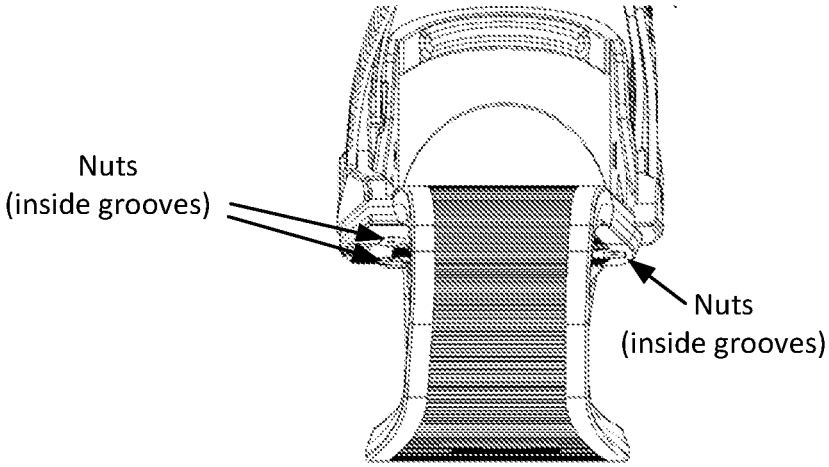
In FIG. 5G there is shown a front perspective zoom-in view of the bottom surface of the upper section of the multi-level footwear sole, in accordance with embodiments.

Reference is now made to FIG. 5G where there is shown a front perspective zoom-in view showing three nuts connecting, along with respective bolts, the front outer and front inner sides of an exemplary multi-level footwear sole with a footwear-connection-structure. The groove-sunk bolts are shown to form a flat surface with the bottom surface of the upper section of the multi-level footwear sole. In the FIGURE, the front and the rear interconnection sections, of the exemplary multi-level footwear sole, are shown to be narrower than its upper and lower sections.

Figure 5H:
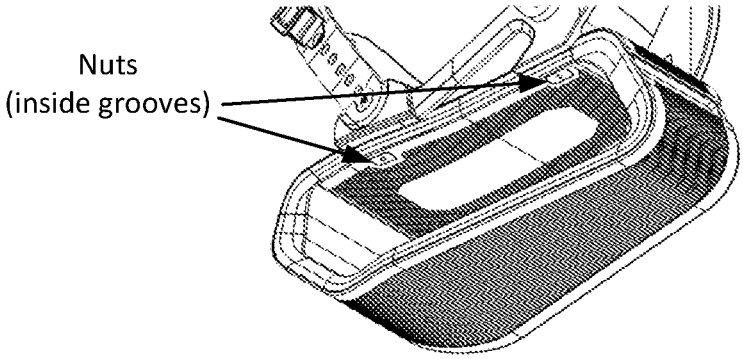
In FIG. 5H there is shown a second bottom perspective zoom-in view of the bottom surface of the upper section of the multi-level footwear sole, in accordance with embodiments.

Reference is now made to FIG. 5H where there is shown a bottom perspective zoom-in view showing two nuts connecting, along with respective bolts, the inner side of an exemplary multi-level footwear sole with a footwear-connection-structure. The groove-sunk bolts are shown to form a flat surface with the bottom surface of the upper section of the multi-level footwear sole.

According to some embodiments, a multi-level footwear sole may include a lower section having a narrowed/concaved/indented shape on its inner, bike facing side, for facilitating and improving the disengagement and release of the multi-level footwear sole from vehicle components (e.g. brake paddle, gear paddle, peg) interfaced during riding. As the rider may initially raise his foot/feet before lowering it/them for ground support, for example when stopping or taking sharp turns, the narrowed/concaved/indented shape enables seamless release.

Figure 6A:
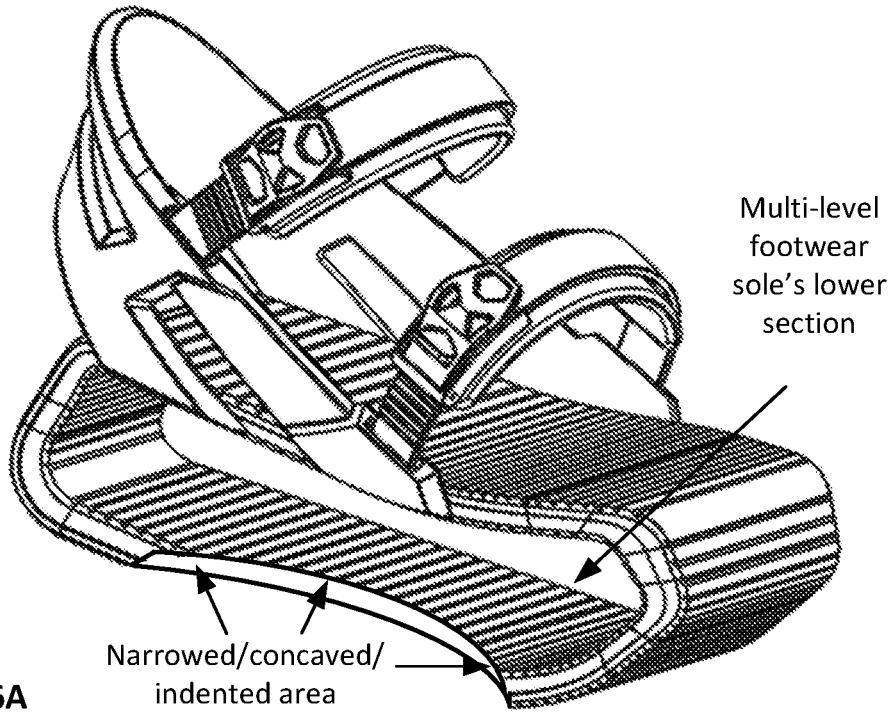
In FIG. 6A there is shown a top perspective view of an exemplary multi-level footwear sole including a lower section narrowed/concaved/indented on its inner, bike facing side (left side sole shown), in accordance with embodiments.
Figure 6B:
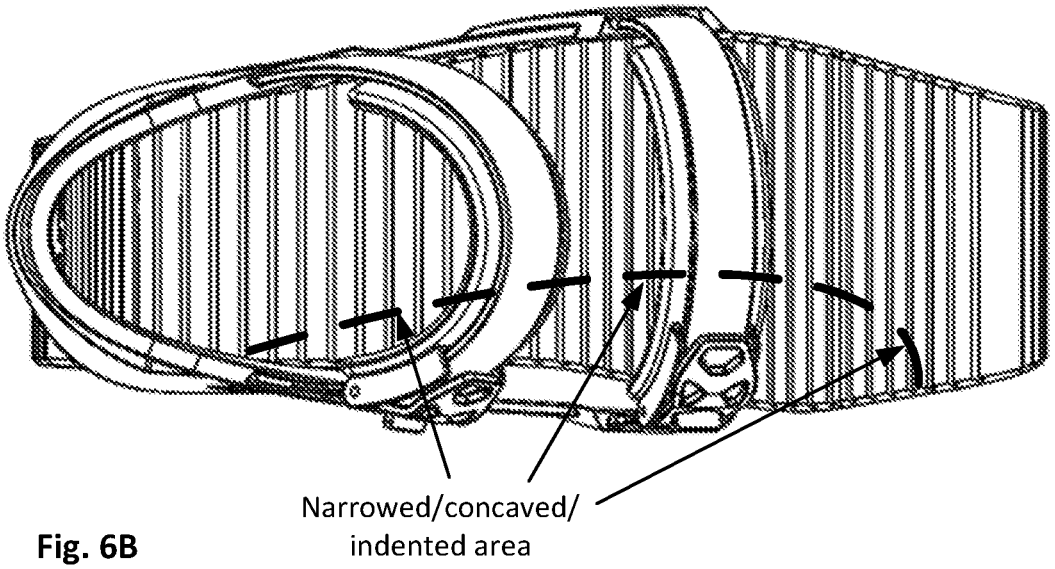
In FIG. 6B there is shown a top view of an exemplary multi-level footwear sole including a lower section narrowed/concaved/indented (shown in broken line) on its inner, bike facing side (left side sole shown), in accordance with embodiments.

Reference is now made to FIG. 6A where there is shown a top perspective view of an exemplary multi-level footwear sole including a lower section narrowed/concaved/indented on its inner, bike facing side (left side sole shown). Reference is now made to FIG. 6B where there is shown a top view of an exemplary multi-level footwear sole including a lower section narrowed/concaved/indented (shown in broken line) on its inner, bike facing side (left side sole shown).

According to some embodiments, the inner sides of the edges of the multi-level footwear sole may be chamfered for facilitating and improving the disengagement and release of the multi-level footwear sole from vehicle components (e.g. brake paddle, gear paddle, peg) interfaced during riding. As the rider may initially horizontally slide his foot/feet before lowering it/them for ground support, for example when stopping or taking sharp turns, the chamfered edges enable seamless release.

According to some embodiments, light reflectors and/or battery powered flashlights/LEDs may be integrated into/onto a multi-level footwear sole. For example, reflectors/lights may be positioned at the front of the front interconnection section and/or at the back of rear interconnection section of the multi-level footwear sole.

Figure 7A:
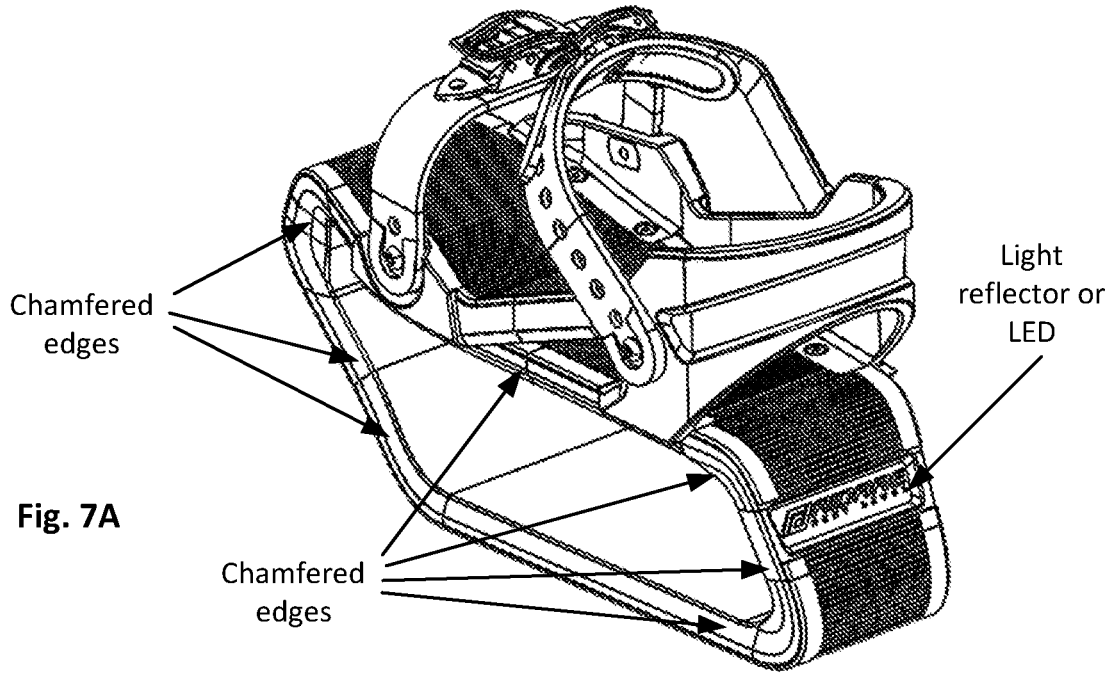
In FIG. 7A there is shown atop perspective of an exemplary multi-level footwear sole, wherein the inner sides of the inner/bike-facing edges of the multi-level footwear sole are chamfered, in accordance with embodiments.
Figure 7B:
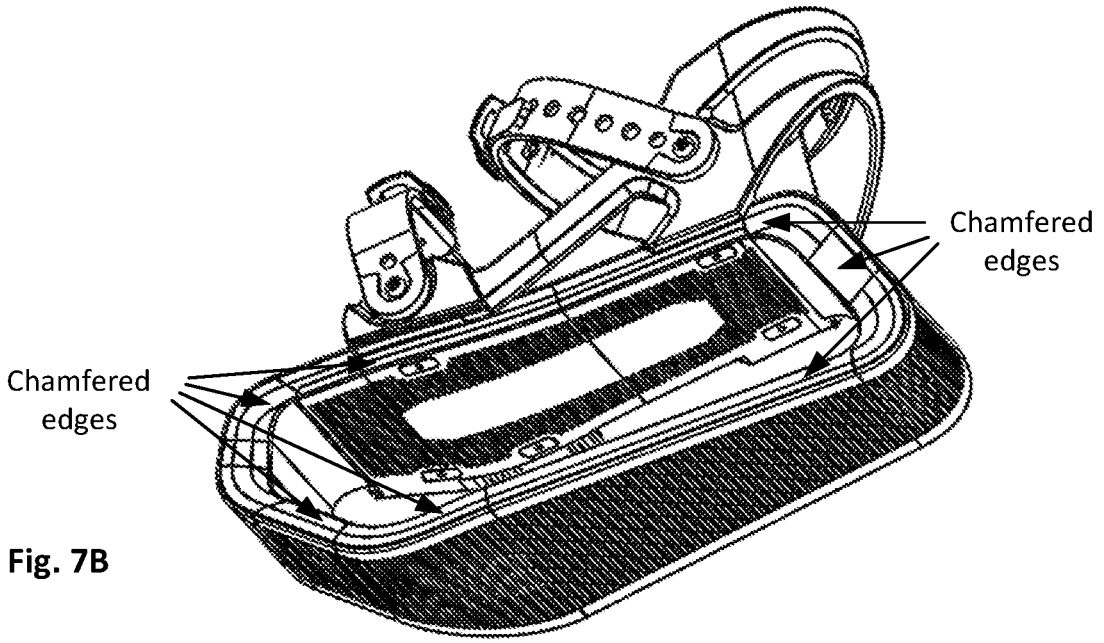
In FIG. 7B there is shown a bottom perspective of an exemplary multi-level footwear sole, wherein the inner sides of the inner/bike-facing edges of the multi-level footwear sole are chamfered, in accordance with embodiments.

Reference is now made to FIG. 7A where there is shown a top perspective of an exemplary multi-level footwear sole, in accordance with embodiments, wherein the inner sides of the inner/bike-facing edges of the multi-level footwear sole are chamfered. Further shown in the FIGURE is a light reflector or LED device positioned on the back side of the rear interconnection section. Reference is now made to FIG. 7B where there is shown a bottom perspective of an exemplary multi-level footwear sole, in accordance with embodiments, wherein the inner sides of the inner/bike-facing edges of the multi-level footwear sole are chamfered.

According to some embodiments, the bottom section/sole, the front interconnection section and/or the rear interconnection section, of the multi-level footwear sole, may include holes/openings/hollow-areas. The holes/openings/hollow-areas may, for example, reduce the weight of the multi-level footwear sole and/or reduce the amount/cost of materials needed for its production.

Figure 8A:
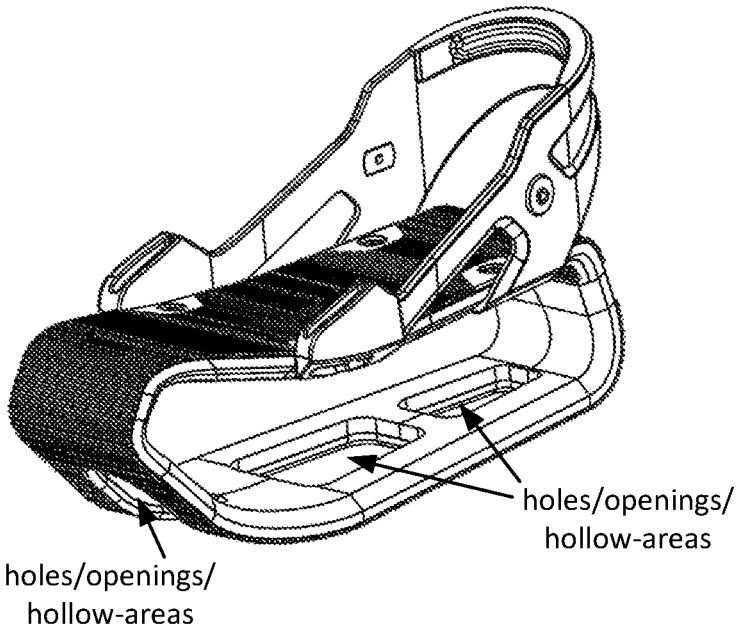
In FIG. 8A there is shown a top perspective view of an exemplary multi-level footwear sole, wherein the bottom section/sole and the front interconnection section include holes/openings, in accordance with embodiments.
Figure 8B:
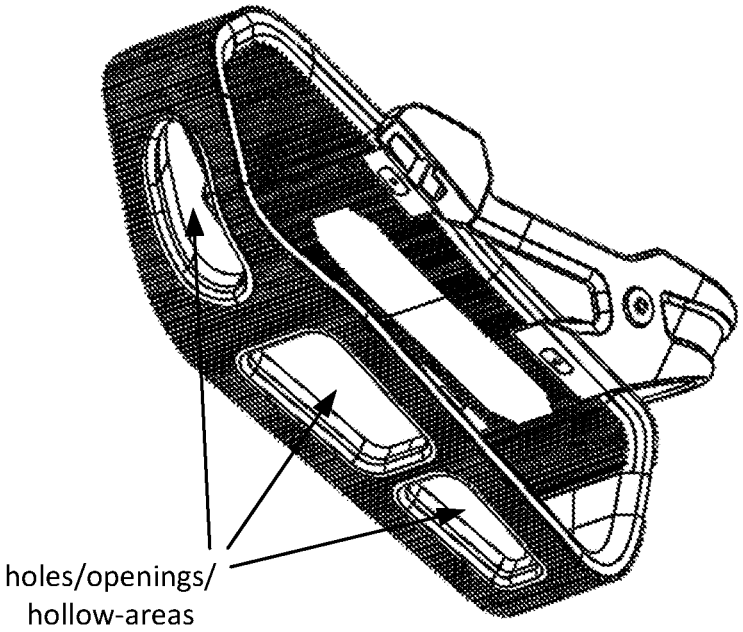
In FIG. 8B there is shown a bottom perspective view of an exemplary multi-level footwear sole, wherein the bottom section/sole and the front interconnection section include holes/openings, in accordance with embodiments.

Reference is now made to FIG. 8A where there is shown a top perspective view of an exemplary multi-level footwear sole, in accordance with embodiments, wherein the bottom section/sole and the front interconnection section include holes/openings. Reference is now made to FIG. 8B where there is shown a bottom perspective view of an exemplary multi-level footwear sole, in accordance with embodiments, wherein the bottom section/sole and the front interconnection section include holes/openings.

According to some embodiments, a multi-level footwear sole may include an upper section having a sticking-out ledge/shelf at the front instep-arch side of the upper section, for facilitating and improving engagement with specific vehicle components (e.g. brake paddle, gear paddle, peg) interface. According to some embodiments, both the top surface and bottom surface of the ledge/shelf may be structured for vehicle components interface, for example, the bottom surface of the ledge/shelf, of a left foot multi-level footwear sole, may be engaged with a motorbike's gear paddle to change to a lower gear and the top surface engaged for raising the paddle to change to a higher gear.

According to some embodiments, the ledge/shelf may be elevated in relation to the upper sole of the multi-level footwear sole, forming a step between the bottom surface of the upper sole and the bottom surface of the ledge/shelf. The ledge/shelf may accordingly be positioned/heightened to partially or fully overlap with the sole of the bike rider's boot/shoe that is connected to the multi-level footwear sole.

Figure 9A:
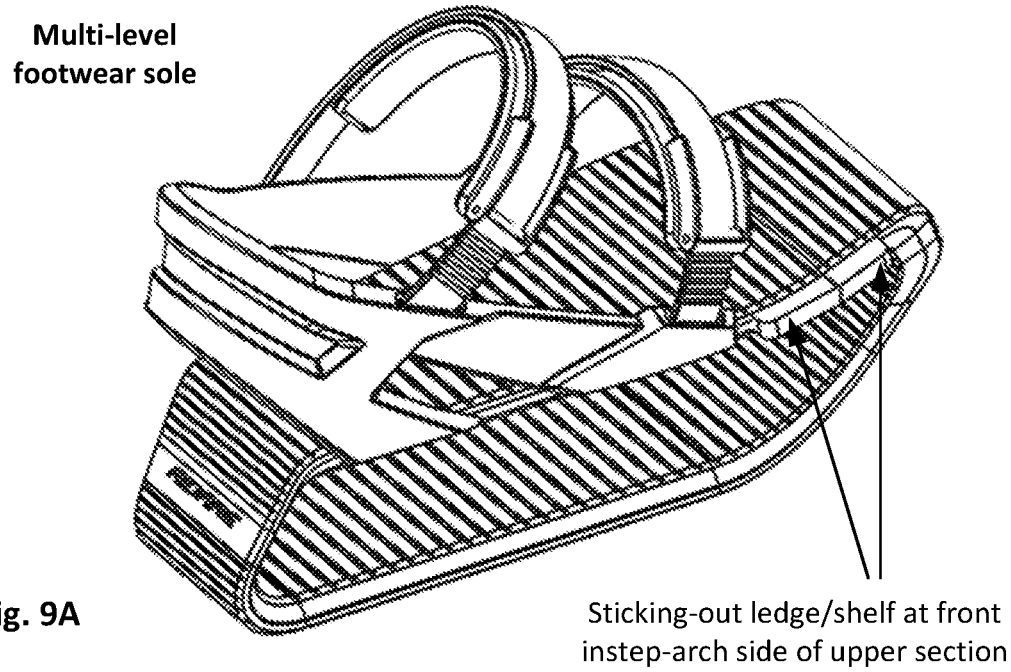
In FIG. 9A there is shown a perspective view of an exemplary multi-level footwear sole including a sticking-out ledge/shelf at the front instep-arch side of the upper section (left sole shown), in accordance with embodiments.
Figure 9B:
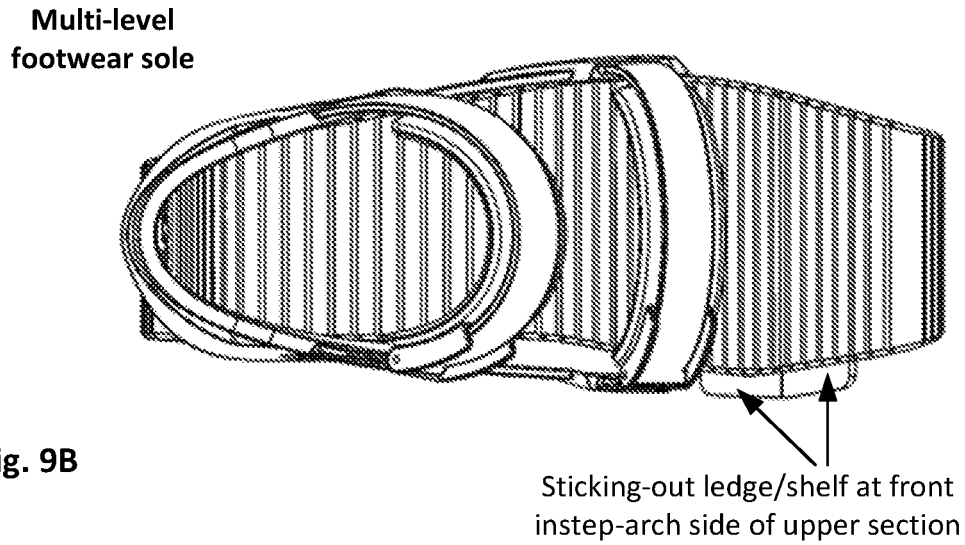
In FIG. 9B there is shown a top view of an exemplary multi-level footwear sole including a sticking-out ledge/shelf at the front instep-arch side of the upper section (left sole shown), in accordance with embodiments.

Reference is now made to FIG. 9A where there is shown a perspective view of an exemplary multi-level footwear sole including a sticking-out ledge/shelf at the front instep-arch side of the upper section (left sole shown). Reference is now made to FIG. 9B where there is shown a top view of an exemplary multi-level footwear sole including a sticking-out ledge/shelf at the front instep-arch side of the upper section (left sole shown).

Figure 9C:
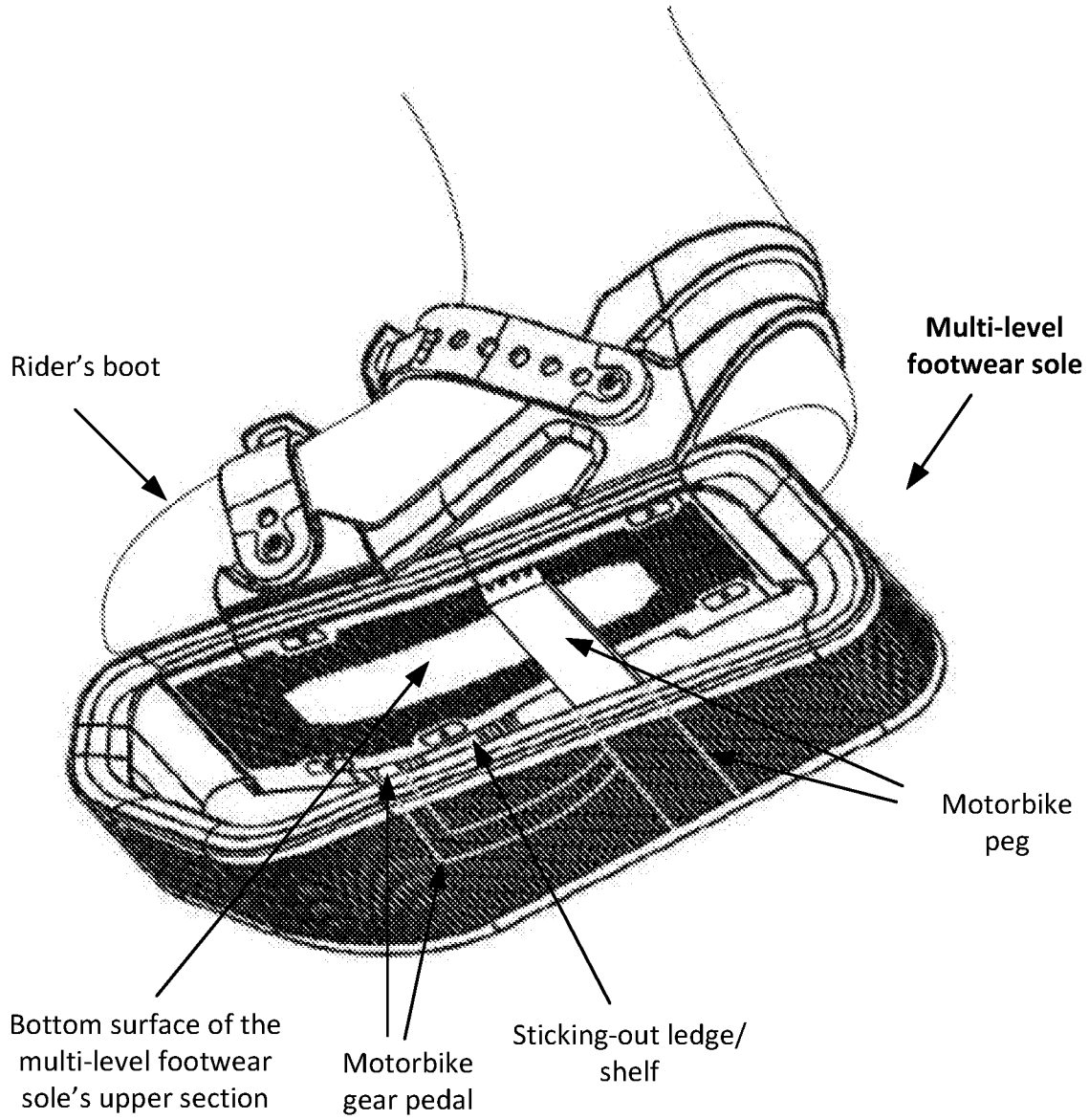
In FIG. 9C there is shown a bottom perspective view of an exemplary multi-level footwear, wherein the sticking-out ledge/shelf is shown to engage/interface with a gear pedal of a motorbike during riding, in accordance with embodiments.

Reference is now made to FIG. 9C where there is shown a bottom perspective view of an exemplary multi-level footwear sole including a sticking-out ledge/shelf at the front instep-arch side of the upper section (left sole shown), wherein the sticking-out ledge/shelf is shown to engage/interface with a gear pedal of a motorbike during riding, while the mid-bottom surface of the multi-level footwear sole's upper section is rested on and supported by the motorbike's peg.

An exemplary multi-level footwear sole may include a 'strap hole' movement mechanism, in accordance with embodiments, wherein the 'strap hole' enables the movement of the connection point/axis of the straps to the footwear connection support structure and/or to change the angle at which the straps are connected to the support structure.

Figure 10A:
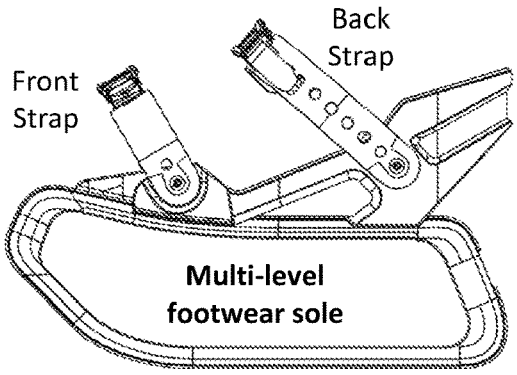
In FIG. 10A there is shown a side perspective of an exemplary multi-level footwear sole including a 'strap hole' movement mechanism, wherein the front strap is shown in a forward directed/tilted angle, in accordance with embodiments.
Figure 10B:
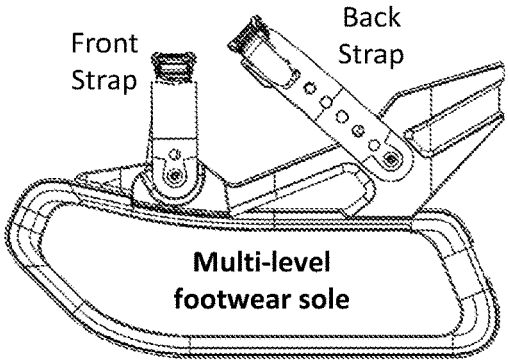
In FIG. 10B there is shown a side perspective of an exemplary multi-level footwear sole including a 'strap hole' movement mechanism, wherein the front strap connection angle was changed (from the FIG. 10A position) and is shown in an upward directed angle, in accordance with embodiments.

Reference is now made to FIG. 10A where there is shown a side perspective of an exemplary multi-level footwear sole including a 'strap hole' movement mechanism, in accordance with embodiments, wherein the front strap is shown in a forward directed/tilted angle. Reference is now made to FIG. 10B where there is shown a side perspective of an exemplary multi-level footwear sole including a 'strap hole' movement mechanism, in accordance with embodiments, wherein the front strap connection angle was changed (from the FIG. 10A position) and is shown in an upward directed angle.

Figure 10C:
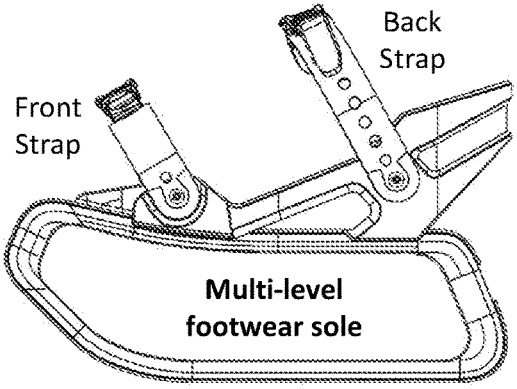
In FIG. 10C there is shown a side perspective of an exemplary multi-level footwear sole including a 'strap hole' movement mechanism, wherein the back strap is shown in a up & forward directed/tilted angle, in accordance with embodiments.
Figure 10D:
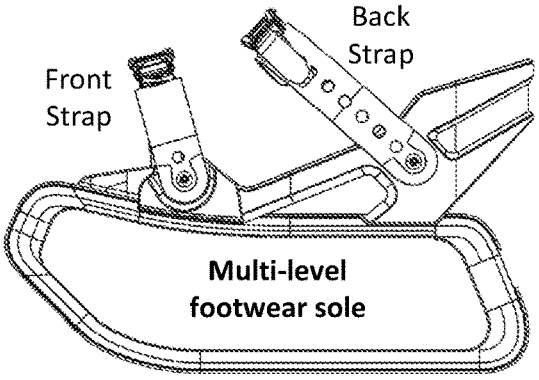
In FIG. 10D there is shown a side perspective of an exemplary multi-level footwear sole including a 'strap hole' movement mechanism, wherein back strap connection angle was changed (from the FIG. 10C position) and is shown in a down & forward directed/tilted angle, in accordance with embodiments.

Reference is now made to FIG. 10C where there is shown a side perspective of an exemplary multi-level footwear sole including a 'strap hole' movement mechanism, in accordance with embodiments, wherein the back strap is shown in a up & forward directed/tilted angle. Reference is now made to FIG. 10D where there is shown a side perspective of an exemplary multi-level footwear sole including a 'strap hole' movement mechanism, in accordance with embodiments, wherein back strap connection angle was changed (from the FIG. 10C position) and is shown in a down & forward directed/tilted angle.

According to some embodiments, an exemplary multi-level footwear sole, in accordance with embodiments, may be designed/built at various 'internal height/distance' (between the top and bottom sections) to 'internal length' ratios. According to some embodiments, an exemplary multi-level footwear sole may have an 'internal height/distance' (between the top and bottom sections) to 'internal length' ratio of 0.4 or more. According to some embodiments, an exemplary multi-level footwear sole may have an 'internal height/distance' (between the top and bottom sections) to 'internal length' ratio of 0.25 or more.

According to some embodiments, an exemplary multi-level footwear sole may have an 'internal height/distance' of between 10 and 11 centimeters. Sufficient 'internal height/distance', in accordance with some embodiments, may provide the multi-level footwear sole with vertical movement freedom—as it has access internal height space—when positioned over a motorbike's pegs.

Figure 11:
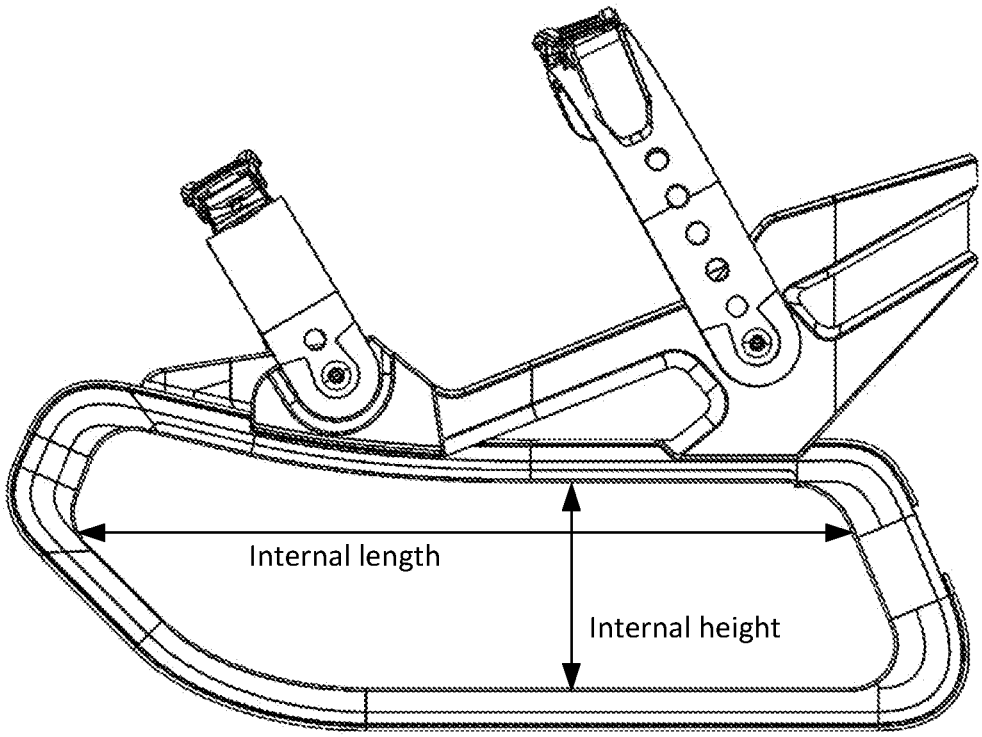
In FIG. 11 there is shown a side view of an exemplary multi-level footwear sole, wherein the 'internal height/distance' and the 'internal length' are shown and, wherein the 'internal height/distance' (between the top and bottom sections) to 'internal length' ratio is more than 0.25, in accordance with embodiments.

Reference is now made to FIG. 11 where there is shown a side view of an exemplary multi-level footwear sole, in accordance with embodiments, wherein the 'internal height/distance' and the 'internal length' are shown and, wherein the 'internal height/distance' (between the top and bottom sections) to 'internal length' ratio is more than 0.25.

According to some embodiments, a multi-level footwear sole may include a downward opening lower section. Part of the multi-level footwear sole's lower section, the entire lower section and/or a combination of the lower section and interconnection section(s)—may be connected to rest of the multi-level sole by an axle and spring mechanism. The spring may bias the downward opening lower section to remain up and closed, raising of the bike/motorbike riders leg may cause one or more of the bike's/motorbike's control and operation components to push downward against the top of the multi-level sole's lower section, causing it to open downward around the axis against the spring's bias, thus enabling the rider to vertically release his feet from a riding position and move into a stopping/standing position contacting the ground with the multi-level sole's bottom. Upon release, the spring's bias may cause the opening section to close again, one or more tracks, stoppers and/or limiters may prevent the opening section's from travelling further upwards beyond the plane of the lower level of the sole, making it part of the rider's ground contacting surface/outsole when standing/walking with the multi-level sole.

Figure 12A:
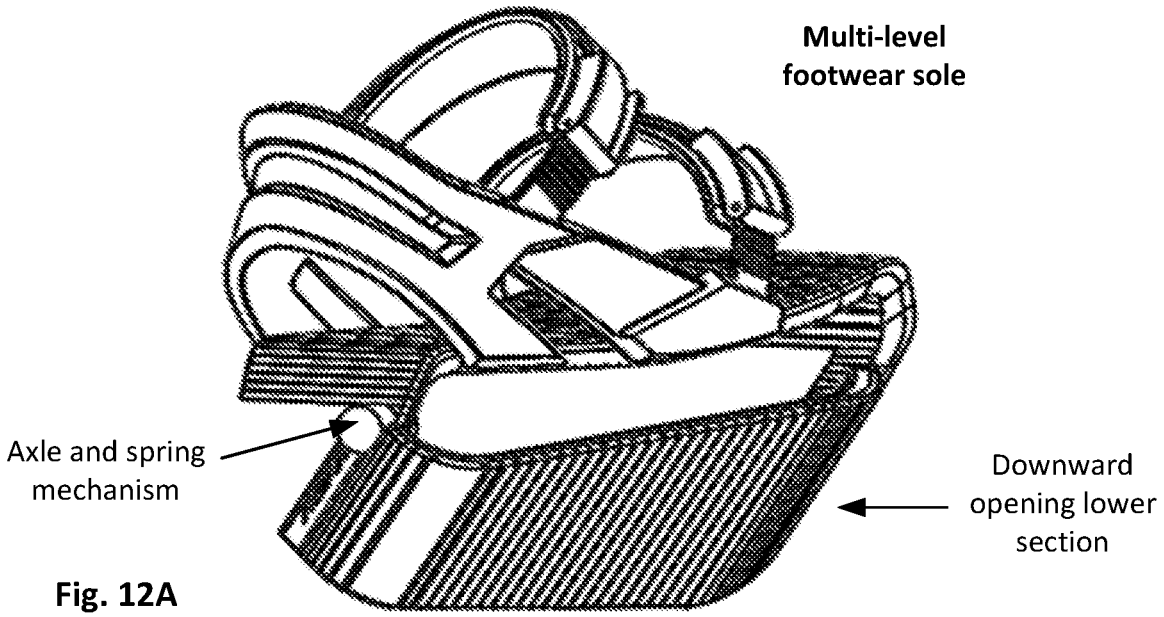
In FIG. 12A there is shown a perspective view of a downward opening lower section of an exemplary multi-level footwear sole, wherein the entire lower section, and parts of the interconnection sections, of the multi-level sole are designed to open downwards, in accordance with embodiments.

Reference is now made to FIG. 12A where there is shown a perspective view of a downward opening lower section of an exemplary multi-level footwear sole, wherein the entire lower section, and parts of the interconnection sections, of the multi-level sole are designed to open downwards.

Figure 12B:
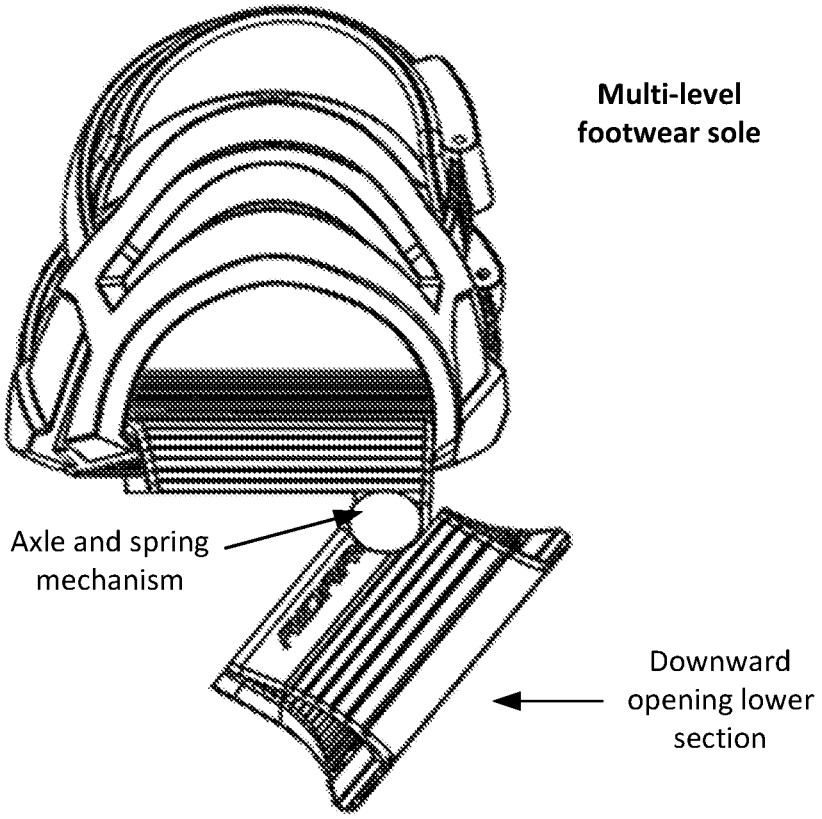
In FIG. 12B there is shown a back view of a downward opening lower section of an exemplary multi-level footwear sole, wherein the entire lower section, and parts of the interconnection sections, of the multi-level sole are designed to open downwards, in accordance with embodiments.

Reference is now made to FIG. 12B where there is shown a back view of a downward opening lower section of an exemplary multi-level footwear sole, wherein the entire lower section, and parts of the interconnection sections, of the multi-level sole are designed to open downwards.

Figure 13:
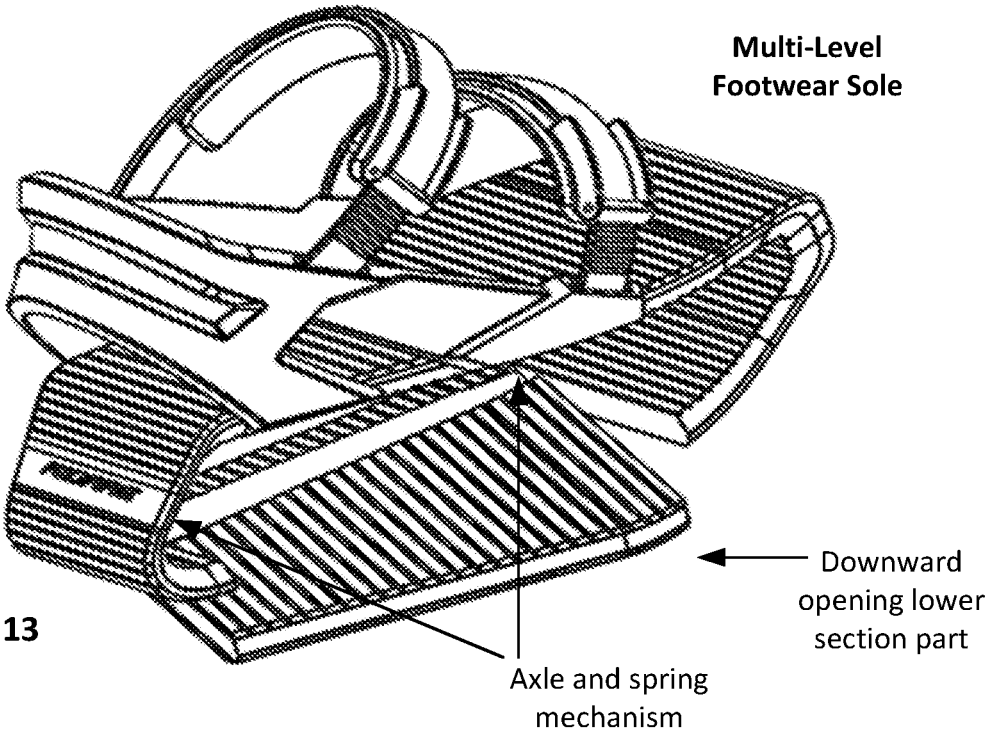
In FIG. 13 there is shown a perspective view of a downward opening lower section of an exemplary multi-level footwear sole, wherein part of the lower section of the multi-level sole is designed to open downwards, in accordance with embodiments.

Reference is now made to FIG. 13 where there is shown a perspective view of a downward opening lower section of an exemplary multi-level footwear sole, wherein part of the lower section of the multi-level sole is designed to open downwards.

Figure 14:
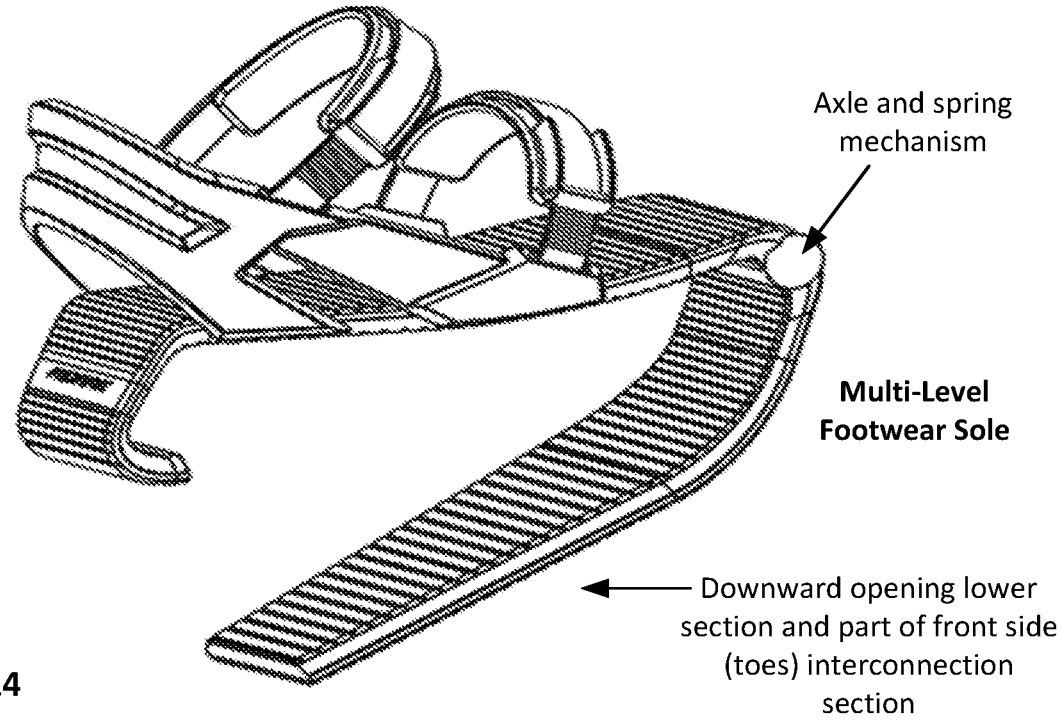
In FIG. 14 there is shown a perspective view of a downward opening lower section of an exemplary multi-level footwear sole, wherein the entire lower section, and part of a front side (toes) interconnection section/element, of the multi-level sole is designed to open downwards, in accordance with embodiments.

Reference is now made to FIG. 14 where there is shown a perspective view of a downward opening lower section of an exemplary multi-level footwear sole, wherein the entire lower section, and part of a front side (toes) interconnection section/element, of the multi-level sole is designed to open downwards.

According to some embodiments, the structure of an exemplary multi-level sole may resemble a parallelogram when viewed from a side perspective and may be flexible. As pressure (e.g. rider's weight and/or inertia) is applied on the upper section, and the lower section is in contact with the ground or pushing against another stable object/surface, the shape of the parallelogram may at least partially collapse/flatten forward and downward and, in accordance with some embodiments, may generate resistance and shock absorption effect.

According to some embodiments, one or more of the axles (between interconnection sections and soles) may include a spring mechanism (integrated into one or more of the axles) to bias the sole to an open position, when no pressure is applied upon the bottom section. According to some embodiments, one or more of the axles (between interconnection sections and soles) may include a locking mechanism (integrated into one or more of the axles) to retain the sole at a fully open position (for riding), a fully closed/flattened position (for walking), or a position therebetween.

Figure 15A:
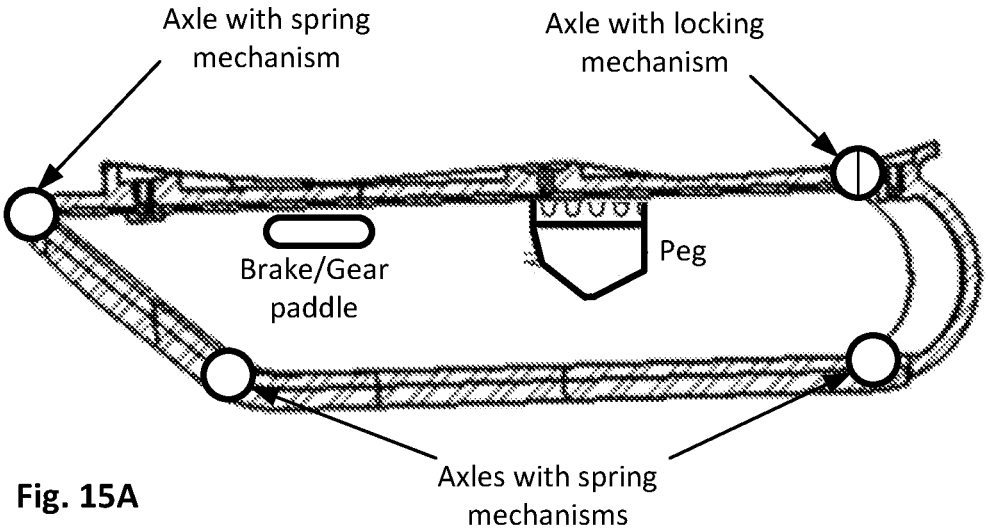
In FIG. 15A there is shown a perspective view of a first 'open' position of an exemplary folding (flattening) multi-level footwear sole, in accordance with embodiments.

Reference is now made to FIG. 15A where there is shown a perspective view of a first 'open' position of an exemplary folding (flattening) multi-level footwear sole, in accordance with embodiments, wherein 4 axles (between interconnection sections and soles) with spring mechanisms and/or locking mechanisms (integrated into one or more of the axles) to bias(spring)/retain(lock) the sole to an open position, wherein, when top pressure is put onto the upper section and the lower section is in contact with a stable/static surface (e.g. ground) the multi-level sole's shape, if not locked to an open state, flattens at the axles against the spring bias (the side view parallelogram flattens to a certain extent).

Figure 15B:
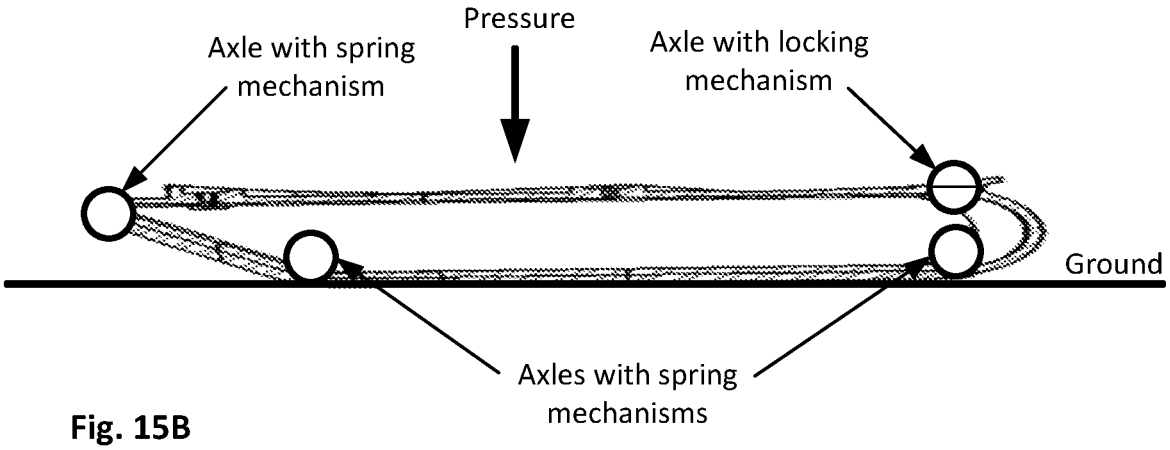
In FIG. 15B there is shown a perspective view of a second 'closed' (flattened) position of an exemplary folding (flattening) multi-level footwear sole, in accordance with embodiments.

Reference is now made to FIG. 15B where there is shown a perspective view of a second 'closed' (flattened) position of an exemplary folding (flattening) multi-level footwear sole, in accordance with embodiments, wherein 4 axles (between interconnection sections and soles) with spring mechanisms and/or locking mechanisms (integrated into one or more of the axles) to bias-against (spring mechanism) the sole when pressured into or locked in a flat position, or to retain (locking mechanism) the sole in the flat position.

According to some embodiments, a multi-level footwear sole may be designed to function as a one-size-fits-all footwear. The sole's connection straps may be set to various lengths, for example by selecting a specific strap hole to connect with the footwear connection structure or tightening the strap(s) mechanism (e.g. rachet), to accommodate various shoe/boot sizes. The rear section of the footwear connection structure may retain the rider's shoe/boot, preventing it from sliding backwards over the soles as the connection straps are tightened.

Figure 16A:
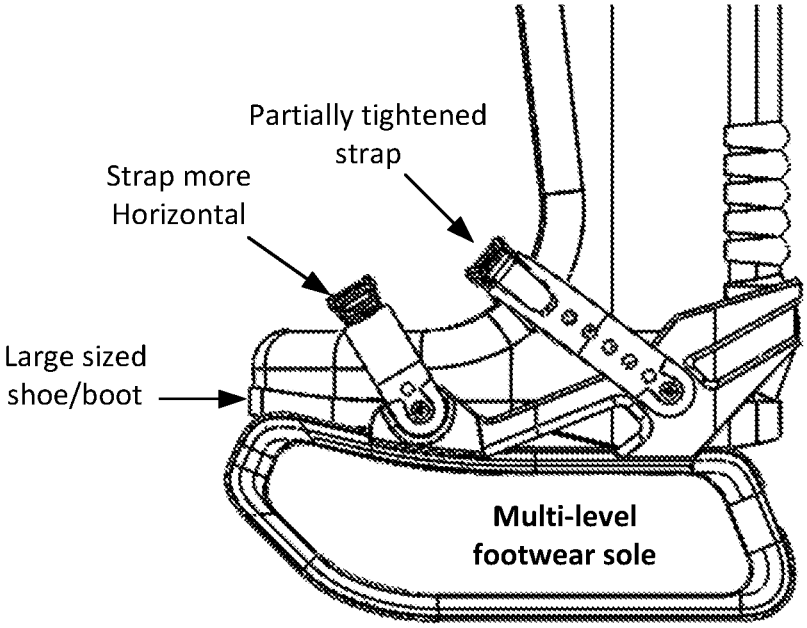
In FIG. 16A there is shown a side view of an exemplary multi-level footwear sole, connected to a large sized (e.g. size 45) boot, in accordance with embodiments.
Figure 16B:
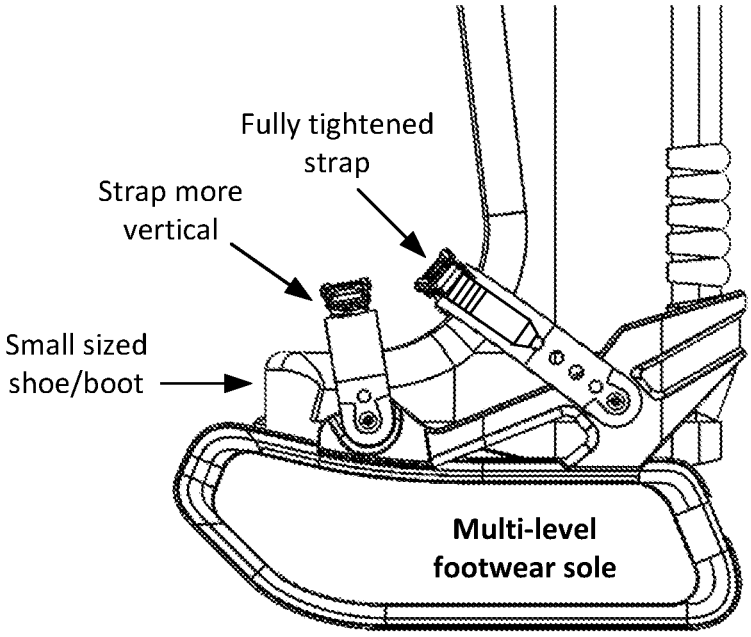
In FIG. 16B there is shown a side view of an exemplary multi-level footwear sole, connected to a small sized (e.g. size 36) boot, in accordance with embodiments.

Reference is now made to FIG. 16A where there is shown a side view of an exemplary multi-level footwear sole, in accordance with embodiments, connected to a large sized (e.g. size 45) boot—rider toes reach end of sole and straps are slightly tightened. Reference is now made to FIG. 16B where there is shown a side view of an exemplary multi-level footwear sole, in accordance with embodiments, connected to a small sized (e.g. size 36) boot—rider toes do not reach end of sole and straps are further tightened.

According to some embodiments, a multi-level footwear sole may be designed to accept and connect to interchangeable bottom outsoles, wherein a complementary gap on the bottom lower section of the multi-level footwear sole may position, accept, and retain a selected outsole out of multiple interchangeable outsoles, for example, each sole intended for different train types such as asphalt, cement, dirt, mud, sand, snow, ice, rock, or other). According to some embodiments, the interchangeable soles may be retained within the outsole complementary gap by screws, nuts and bolts, glue or adhesive, magnets, Velcro, position slots/tracks, pressure, or any other attachment means or mechanism.

According to some embodiments, a multi-level footwear sole may be designed to connect, in its entirety but without the footwear connection structure, to a footwear (e.g. shoe, boot) having interchangeable bottom outsoles, wherein the multi-level footwear sole may connect to the footwear using similar mechanism to that utilized by the other interchangeable outsoles of the footwear.

Figure 17A:
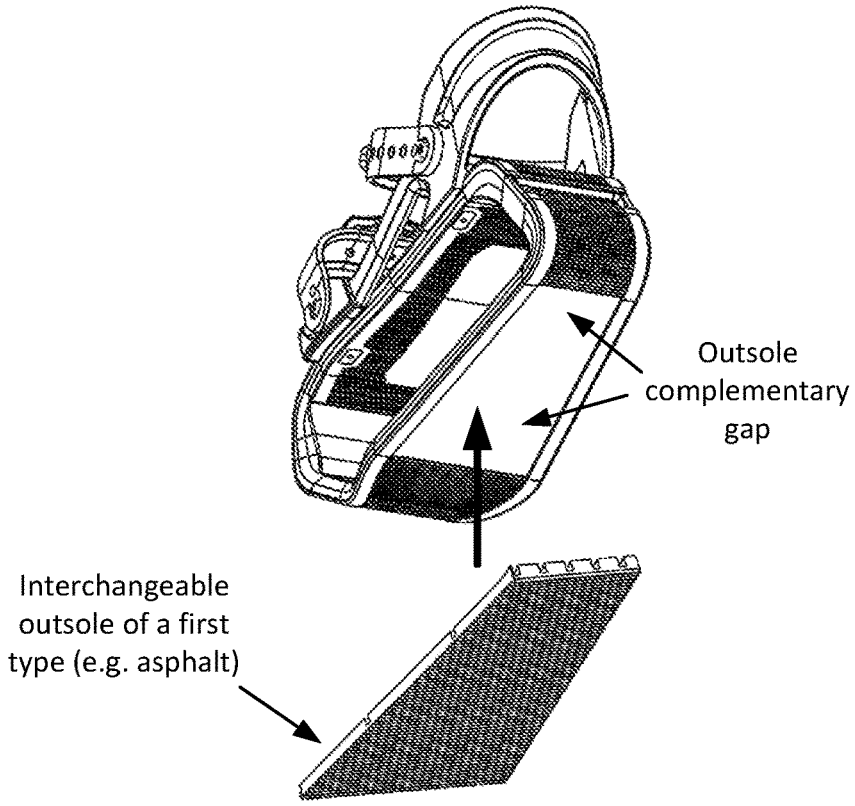
In FIG. 17A there is shown a bottom perspective of an exemplary multi-level footwear sole, designed for interchangeable bottom outsoles, with an outsole of a first type, in accordance with embodiments.
Figure 17B:
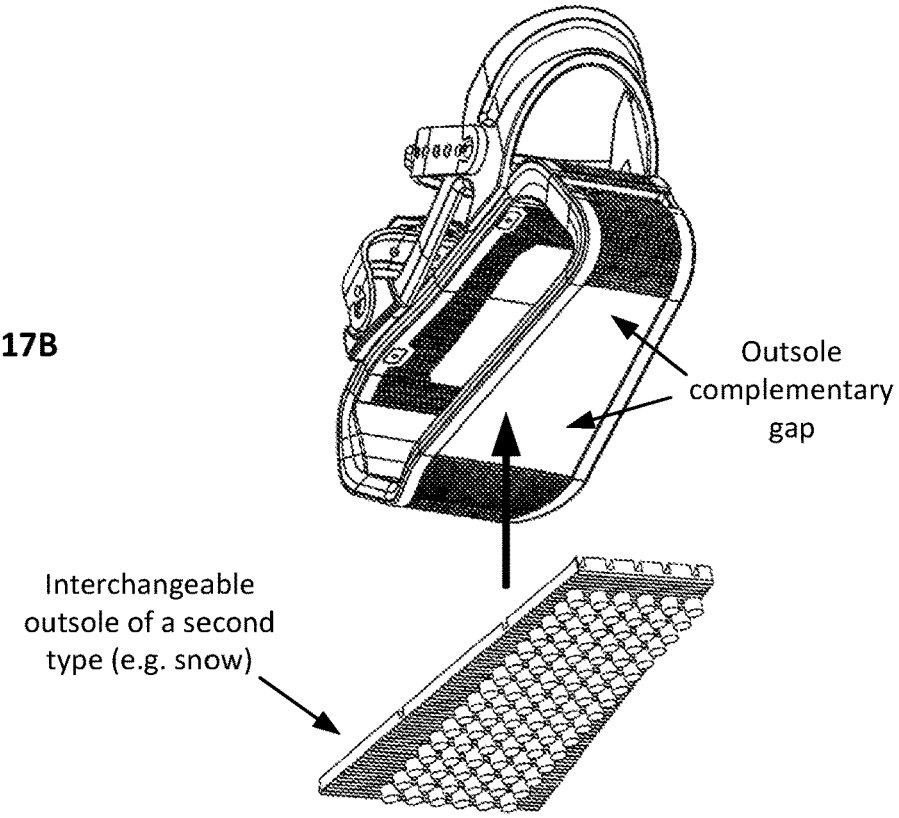
In FIG. 17B there is shown abottom perspective of an exemplary multi-level footwear sole, designed for interchangeable bottom outsoles, with an outsole of a second type, in accordance with embodiments.

Reference is now made to FIG. 17A where there is shown a bottom perspective of an exemplary multi-level footwear sole, in accordance with embodiments, designed for interchangeable bottom outsoles, wherein a complementary gap on the lower section of the multi-level footwear sole is shown to accept an outsole of a first type (e.g. asphalt). Reference is now made to FIG. 17B where there is shown a bottom perspective of an exemplary multi-level footwear sole, in accordance with embodiments, designed for interchangeable bottom outsoles, wherein a complementary gap on the lower section of the multi-level footwear sole is shown to accept an outsole of a second type (e.g. snow).

According to some embodiments, the front and/or rear sections of the multi-level footwear sole may be thicker than the upper and lower sections. According to further embodiments, the front and/or rear sections, and optionally the bottom section, of the multi-level footwear sole may include enforcement elements to increase their strength, durability and/or flexibility, wherein the enforcement elements may include any combination of structures, ridges, beams, rails, strings, solid (not hollow) sections, and/or layers.

Figure 18A:
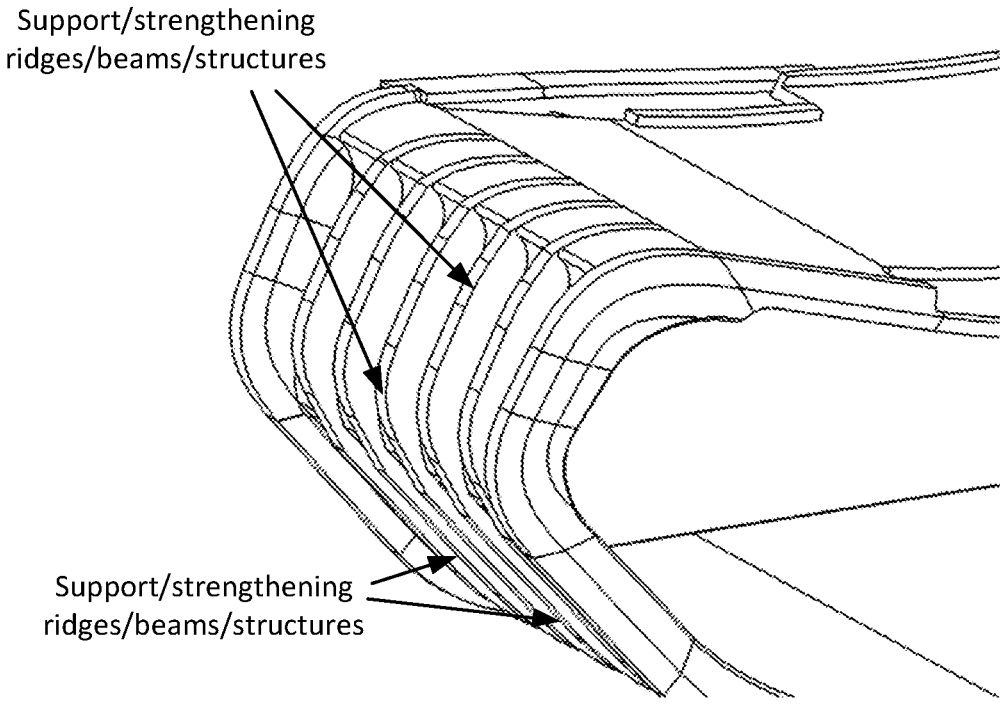
In FIG. 18A there is shown a top perspective of an exemplary multi-level footwear sole, having support/strengthening ridges/beams/structures at its front (toes) interconnection section, in accordance with embodiments.
Figure 18B:
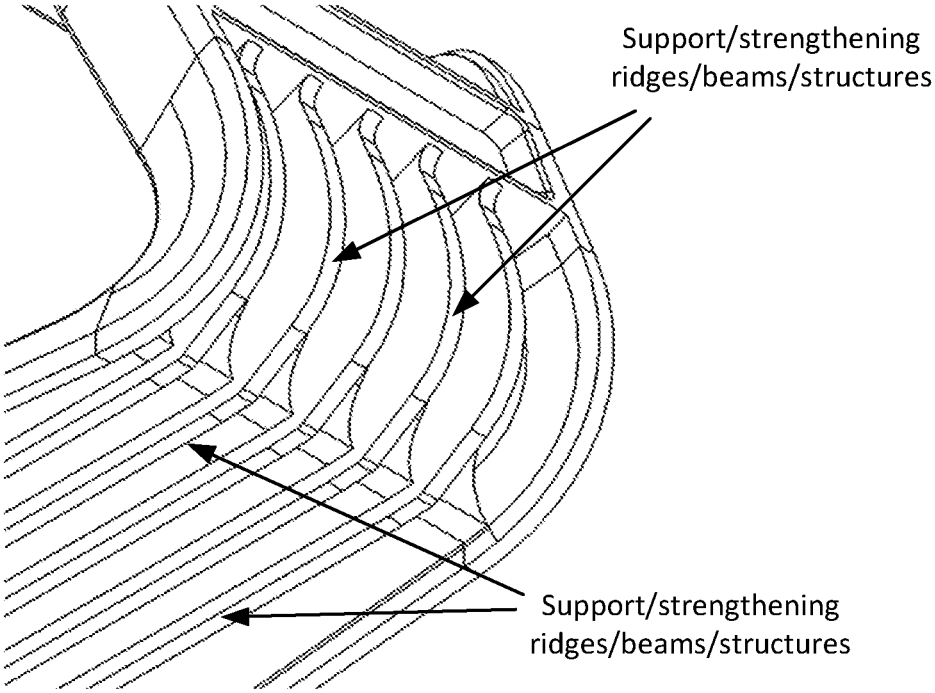
In FIG. 18B there is shown a bottom perspective of an exemplary multi-level footwear sole, having support/strengthening ridges/beams/structures at its rear (heel) interconnection section and at its bottom sole, in accordance with embodiments.

Reference is now made to FIG. 18A where there is shown a top perspective of an exemplary multi-level footwear sole, in accordance with embodiments, having support/strengthening ridges/beams/structures at its front (toes) interconnection section. Reference is now made to FIG. 18B where there is shown a bottom perspective of an exemplary multi-level footwear sole, in accordance with embodiments, having support/strengthening ridges/beams/structures at its rear (heel) interconnection section and at its bottom sole.

According to some embodiments, the front and/or rear sections of the multi-level footwear sole may include enforcement elements to increase their strength, durability, compressive load ability, and/or flexibility, wherein the enforcement elements may include a front and/or rear support/strengthening walls/fins/structures positioned substantially along a central longitudinal line, inside of the multi-level footwear sole. The walls/fins/structures may run from the upper sole along the interconnection section and reach into the bottom sole, wherein a front wall/fin/structure may for example reach back roughly to a position under the wearer's ball of the foot, and a rear wall/fin/structure may for example reach forward roughly to a position under the wearer's heel/heel-center.

Figure 18C:
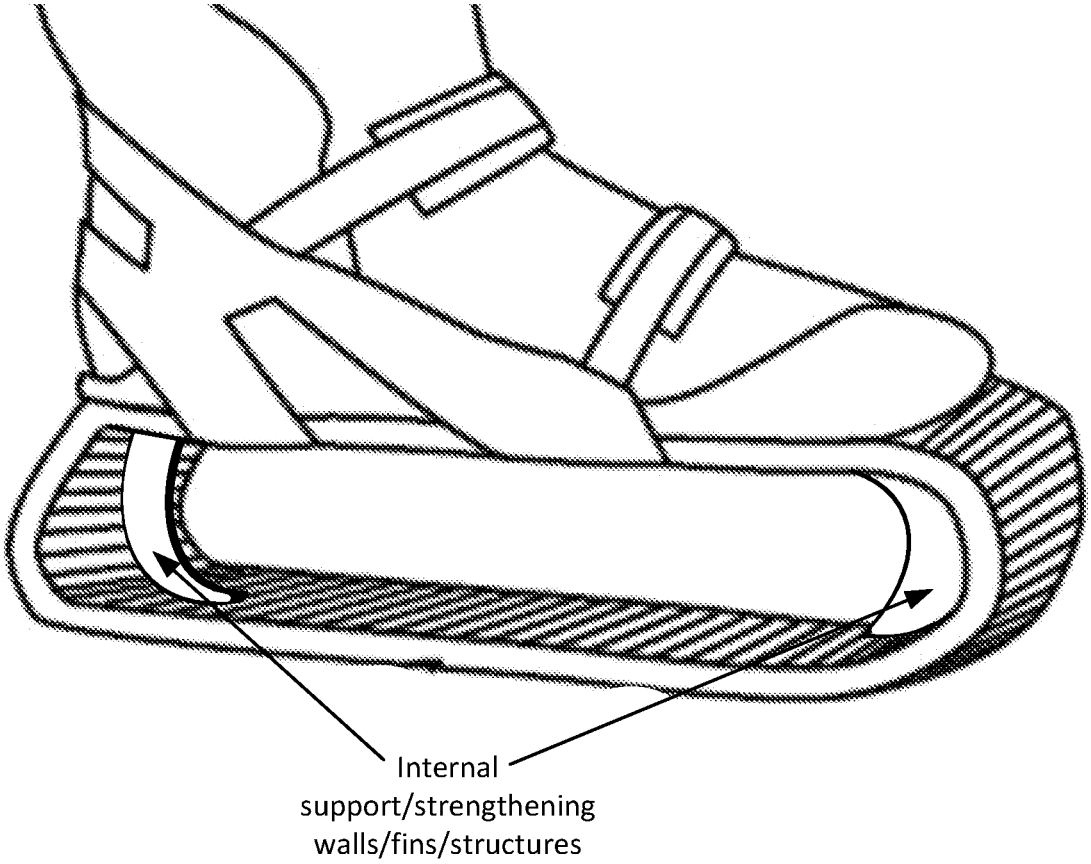
In FIG. 18C where there is shown a side perspective of an exemplary multi-level footwear sole, in accordance with embodiments, having support/strengthening walls/fins/structures at its inner front (toes) and rear (heel) sections.

Reference is now made to FIG. 18C where there is shown a side perspective of an exemplary multi-level footwear sole, in accordance with embodiments, having support/strengthening walls/fins/structures at its inner front (toes) and rear (heel) sections.

According to some embodiments, a multi-level footwear sole may, for example, include interconnection elements that form, in concert with the lower and upper sections, an open belt horseshoe shape, wherein the lower and upper sections are connected at their fronts (toes) OR at their rears (heels); and the multi-level sole is open/hollow from/on both its instep-arch and outer-foot sides AND, either on its front (toes) OR rear (heels). According to some embodiments, a multi-level footwear sole may include and utilize various differently shaped and structured interconnecting elements.

Figure 19A:
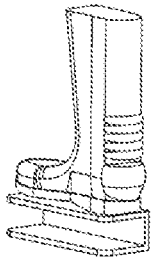
In FIGS. 19A-19B there are shown: a perspective back view (19A) and a perspective front view (19B), of an exemplary multi-level footwear sole having interconnection elements, forming with the lower and upper levels/sections a horseshoe cross-section shape, in accordance with embodiments.
Figure 19B:
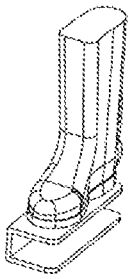

Reference is now made to FIGS. 19A-19B where there are shown: a perspective back view (19A) and a perspective front view (19B), of an exemplary multi-level footwear sole having interconnection elements, wherein—the interconnection elements form, in concert with the lower and upper levels/sections, a horseshoe cross-section shape and the multi-level sole is open/hollow from/on its instep-arch side, front (toes) side AND rear (heels) side.

Figure 20A:
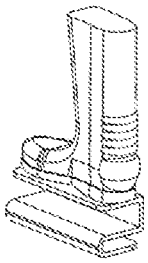
In FIGS. 20A-20B where there are shown: a perspective back view (20A) and a perspective front view (20B), of an exemplary multi-level footwear sole having interconnection elements forming with the lower and upper levels/sections, an 'S' cross-section shape, in accordance with embodiments; and In FIG. 21 there is shown a perspective side view of an exemplary multi-level footwear sole having interconnection wall elements, in accordance with some embodiments.
Figure 20B:
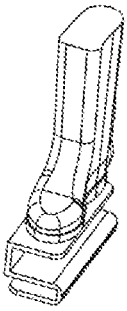

Reference is now made to FIGS. 20A-20B where there are shown: a perspective back view (20A) and a perspective front view (20B), of an exemplary multi-level footwear sole having interconnection elements, wherein—the interconnection elements form, in concert with the lower and upper levels/sections, an 'S' resembling cross-section shape, wherein the lower and upper sections are connected such that the instep-arch side of one level is connected to the outer-foot side of the other level and the multi-level sole is open/hollow from/on its lower outer-foot side and upper instep-arch side.

According to some embodiments, the interconnection elements may take the form of one or more—vertically, horizontally and/or diagonally oriented in relation to the lower and upper sections—walls, blocks, shafts, beams, rods, springs, tubes, cylinders and/or combinations thereof. the elements may retain the lower and upper sections to one another in an orientation forming hollow chamber(s) therebetween with opening(s) to the hollow chamber(s) on the instep-arch side of the Multi-level Sole.

Figure 21:
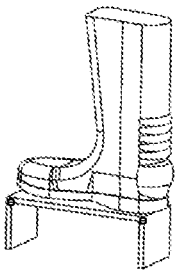

Reference is now made to FIG. 21 where there is shown a perspective side view of an exemplary multi-level footwear sole having interconnection wall elements, wherein—the interconnection wall elements, in accordance with some embodiments, be connected to the upper section by axes, may be folded to a 'closed' position, and may include a spring mechanism to flip open to a vertical 'open' position (shown) to provide additional rider leg reach, while creating hollow bike/motorbike component chambers therebetween.

According to some embodiments of the present invention, a Multi-Level Footwear Sole, may include: (1) a lower section (level) having a top side and a bottom (outsole) side for contacting the ground; (2) an upper section (level) having a top side and a bottom (outsole) side for interfacing with one or more components (physical/control/operational) of a two-wheel vehicle; and (3) a front and a rear interconnection elements/sections for orienting and retaining the upper section in relation to the lower section, such that the upper and lower sections are: (a) positioned at substantially parallel planes and (b) at least partially overlap, wherein the bottom side of the upper section faces the top side of the bottom section, forming therebetween one or more hollow chambers to accommodate/house the one or more interfaced components of the two-wheel vehicle.

According to some embodiments, the Multi-Level Footwear Sole's interconnection elements/sections may form, in concert with the lower and upper sections, a closed belt loop shape, wherein the lower and upper sections are connected at their fronts (toes) and at their rears (heels) and the multi-level footwear sole is open/hollow from/on both its instep-arch and outer-foot sides.

According to some embodiments, the Multi-Level Footwear Sole may further include one or more footwear connection elements.

According to some embodiments the Multi-Level Footwear Sole's footwear connection elements may be selected from the group consisting of: straps, rubber/flexible bands, laces, buckles, ratchets, Velcro and straps/buckles.

According to some embodiments, the Multi-Level Footwear Sole may be integrated with a footwear such that the sole of the footwear, on which the wearer rests his foot, also functions as the upper section of the multi-level footwear sole.

According to some embodiments, the Multi-Level Footwear Sole's bottom surface of the upper section may include one or more grip elements to prevent loss of contact with, or control of, a two-wheel vehicle component.

According to some embodiments, the Multi-Level Footwear Sole's grip elements may be selected from the group consisting of: a layer of non-slip material, structural bumps or ridges and structural dents or channels.

According to some embodiments, the Multi-Level Footwear Sole's grip elements may be structural dents or channels to compliment ridges or edges on a two-wheel vehicle component.

According to some embodiments the Multi-Level Footwear Sole's upper surface of the lower section may be smooth to facilitate seamless release of said multi-level footwear sole from a two-wheel vehicle riding position where a component of the two-wheel vehicle is interfaced by said multi-level footwear sole.

According to some embodiments, the Multi-Level Footwear Sole's upper section may be bowled or bent at its front-center section, inclining towards the front, toes, side of the upper section.

According to some embodiments, the Multi-Level Footwear Sole's front interconnection section may be at least partially constructed of elastic materials to provide cushioning.

According to some embodiments, the Multi-Level Footwear Sole's elastic material may be in the form of an outer layer on the front of the front interconnection section.

According to some embodiments, the Multi-Level Footwear Sole's front interconnection section may be thicker than the rear interconnection section, the lower section and the upper section.

According to some embodiments, the Multi-Level Footwear Sole's bottom section may incline upwards and forward at its front, toes, side.

According to some embodiments, the Multi-Level Footwear Sole's connection areas between the upper and lower sections and the interconnection sections may have a round structure.

According to some embodiments, the Multi-Level Footwear Sole's bottom section and said upper section widen towards their front, toes, side.

According to some embodiments, the Multi-Level Footwear Sole's interconnection sections may be flexible, such that upon the upper section being pressed towards the bottom section, the interconnection sections bend, and the upper section nears the bottom section, while generating resistance and shock absorption effect.

According to some embodiments, the Multi-Level Footwear Sole's upper section may include a sticking-out ledge at its front instep-arch side, for engaging a two-wheel vehicle component.

According to some embodiments, the Multi-Level Footwear Sole's lower section may include an indented area at its instep-arch side, for seamless disengagement of a two-wheel vehicle component.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

The invention claimed is:

1. An attachable motorbike footwear accessory having a closed belt loop shape, said footwear accessory comprising:

a flat lower sole section, positioned along a first plane, having a top side and a bottom side for contacting the ground;

a flat upper sole section, positioned along a second plane substantially parallel to the first plane, having footwear connection elements for connection to a footwear, a top side for supporting the sole of the connected footwear, and a bottom side; and a front interconnection section and a rear interconnection section for orienting said upper sole section in relation to said lower sole section, such that a portion of said upper sole section partially overlaps with a portion of said lower sole section, wherein the bottom side of said upper sole section faces the top side of said bottom sole section, forming therebetween a hollow chamber, open on both the instep-arch side and the outer-foot side of the footwear accessory, for accommodating a peg and a footbrake paddle of a motorbike and, wherein said flat lower sole section inclines towards its front, said flat upper sole section widens towards its front and said flat lower and upper sole sections are thinner than said front and rear interconnection sections.

2. The attachable motorbike footwear accessory according to claim 1, wherein said footwear connection elements are selected from the group consisting of: straps, click-to-lock mechanisms, rubber bands, laces, buckles, rachets and Velcro straps.

3. The attachable motorbike footwear accessory according to claim 1, integrated with a footwear such that the sole of the footwear, on which the wearer rests his foot, also functions as the upper section of the multi-level footwear sole.

4. The attachable motorbike footwear accessory according to claim 1, wherein the bottom surface of said upper sole section includes a grip element to prevent loss of contact with, or control of, a motorbike component.

5. The attachable motorbike footwear according to claim 4, wherein said grip element is selected from the group consisting of: a layer of non-slip material, structural bumps or ridges and structural dents or channels.

6. The attachable motorbike footwear according to claim 4, wherein said grip element is structural dents or channels to compliment ridges or edges on a motorbike component.

7. The attachable motorbike footwear according to claim 1, wherein said front interconnection section is at least partially constructed of elastic materials to provide cushioning.

8. The Multi-Level Footwear Sole attachable motorbike footwear according to claim 7, wherein the elastic material is in the form of an outer layer on the front of said front interconnection section.

* * * * *